US010460892B2

(12) United States Patent
Wu et al.

(10) Patent No.: US 10,460,892 B2
(45) Date of Patent: Oct. 29, 2019

(54) SINGULATED KEYBOARD ASSEMBLIES AND METHODS FOR ASSEMBLING A KEYBOARD

(71) Applicant: Apple Inc., Cupertino, CA (US)

(72) Inventors: Chia Chi Wu, Taipei (TW); Ming Gao, Shanghai (CN); Zheng Gao, Cupertino, CA (US); Zhengyu Li, Shanghai (CN)

(73) Assignee: APPLE INC., Cupertino, CA (US)

( * ) Notice: Subject to any disclaimer, the term of this patent is extended or adjusted under 35 U.S.C. 154(b) by 5 days.

(21) Appl. No.: 16/146,995

(22) Filed: Sep. 28, 2018

(65) Prior Publication Data

US 2019/0035574 A1 Jan. 31, 2019

Related U.S. Application Data

(63) Continuation of application No. 15/230,724, filed on Aug. 8, 2016, now Pat. No. 10,115,544.

(51) Int. Cl.

| | |
|---|---|
| ***H01H 13/88*** | (2006.01) |
| ***H01H 13/70*** | (2006.01) |
| ***H01H 13/14*** | (2006.01) |
| ***H01H 13/02*** | (2006.01) |
| ***H01H 3/12*** | (2006.01) |
| ***H01H 13/83*** | (2006.01) |

(52) U.S. Cl.

CPC ..... *H01H 13/88* (2013.01); *H01H 3/122* (2013.01); *H01H 13/023* (2013.01); *H01H 13/14* (2013.01); *H01H 13/70* (2013.01); *H01H 13/83* (2013.01); *H01H 2205/016* (2013.01); *H01H 2219/062* (2013.01); *H01H 2219/066* (2013.01)

(58) Field of Classification Search

CPC ..... H01H 13/88; H01H 13/14; H01H 13/70; H01H 13/83; H01H 13/023; H01H 3/122; H01H 2205/016; H01H 2219/062; H01H 2219/066

USPC ..... 200/5 A

See application file for complete search history.

(56) References Cited

U.S. PATENT DOCUMENTS

| | | | | |
|---|---|---|---|---|
| 4,987,275 A * | 1/1991 | Miller | H01H 13/702 | 200/275 |
| 5,278,372 A * | 1/1994 | Takagi | H01H 3/125 | 200/344 |
| 2011/0089011 A1* | 4/2011 | Ozaki | H01H 13/83 | 200/512 |

* cited by examiner

*Primary Examiner* — Anthony R Jimenez

(74) *Attorney, Agent, or Firm* — Dorsey & Whitney LLP

(57) ABSTRACT

Methods for assembling low-profile, singulated keyboards by prefabricating key assemblies onto a chassis strip that is divided into individual key assemblies only after the substrate is affixed to a feature plate of keyboard. For example, a row of key assemblies is fabricated onto a chassis strip. The row corresponds to a partial or complete row of keys of the keyboard. The chassis strip is thereafter affixed to a feature plate in a specific location, thereby aligning each prefabricated key assembly to a precise location on the feature plate. While connected, each prefabricated key assembly is independently affixed to the feature plate. Thereafter, interconnecting portions of the chassis strip between the prefabricated key assemblies are removed, thereby singulating each key assembly.

19 Claims, 25 Drawing Sheets

SINGULATED KEYBOARD ASSEMBLIES AND METHODS FOR ASSEMBLING A KEYBOARD

CROSS REFERENCE TO RELATED APPLICATION

This application is a continuation patent application of U.S. patent application Ser. No. 15/230,724, filed 8 Aug. 2016, and titled "Singulated Keyboard Assemblies and Methods for Assembling a Keyboard," the disclosure of which is hereby incorporated by reference herein in its entirety.

FIELD

Embodiments described herein are directed to input devices and, more particularly, to systems and methods for assembling keyboards by installing a row of interconnected key assemblies and then singulating the key assemblies.

BACKGROUND

Electronic devices can receive user input from a keyboard. In some cases, it may be desirable to manufacture a keyboard by fabricating components of the keyboard directly onto a common substrate, generally referred to as a feature plate. A component of a keyboard may be a key assembly including multiple discrete and interconnected parts positioned below a keycap.

Reliably and quickly fabricating components of a keyboard may be challenging, especially for keyboards incorporating components made from small or intricate parts. As such, it may be time-consuming and/or resource intensive to manufacture a keyboard incorporating certain components, such as intricate key assemblies.

SUMMARY

Embodiments described herein relate to, include, or take the form of a method of manufacturing a keyboard including at least the operations of: forming a first key assembly on a first chassis of a chassis strip; forming a second key assembly on a second chassis of the chassis strip; positioning the chassis strip on a feature plate; affixing the first and second chassis to the feature plate; and removing interconnecting portions of the chassis strip that separate the first and second chassis.

In some embodiments, forming the first key assembly includes operations such as, but not necessarily limited to, molding a switch housing onto the first chassis, positioning a key mechanism over the switch housing, engaging a key mechanism with the chassis strip, positioning a buckling dome within the switch housing, and engaging the buckling dome with the chassis strip.

In many embodiments, the first and/or second key assembly can be aligned with an aperture defined by a housing of an electronic device. In these examples, the key assemblies may extend at least partially through the apertures. In many examples, the apertures may be associated with a grid or row of apertures, but this may not be required.

In certain cases, the operation of forming a key assembly includes the operation of forming retaining features onto a respective chassis. For example, a retaining feature may be bent to form a spring armature configured to engage with one or more parts of the key assembly, such as a keycap or a key mechanism. In other cases, a retaining feature can be configured to engage with the buckling dome.

Some embodiments may include a configuration in which affixing the first chassis to the feature plate includes electrically connecting the first key assembly to an electrical circuit accommodated on the feature plate.

Further embodiments described herein reference or take the form of a method of manufacturing a keyboard including at least the operations of: selecting a chassis strip including a number of prefabricated key assemblies; positioning the chassis strip on a feature plate; affixing the chassis strip to the feature plate; and independently affixing each prefabricated key assembly to the feature plate. Further operations can include removing interconnecting portions of the chassis strip.

Additional embodiments described herein reference a method of manufacturing a keyboard including the operations of: selecting a panelized substrate populated with a row of prefabricated key assemblies; affixing the panelized substrate on a feature plate of a keyboard; aligning each prefabricated key assembly of the row of prefabricated key assemblies with a respective one electrical circuit on the feature plate; affixing each key assembly of the row of key assemblies to the feature plate; and depanelizing the panelized substrate to singulate each key assembly on the feature plate.

Some embodiments may include an implementation in which depanelizing the substrate includes removing interconnecting portions of the panelized substrate between each key assembly of the row of key assemblies.

Further embodiments described herein reference a row of interconnected key assemblies. In these embodiments, each key assembly of the row of key assemblies includes a chassis. The chassis includes a first retaining feature and a second retaining feature. The chassis also includes a switch housing, a key mechanism surrounding the switch housing (and engaged with the first retaining feature), and a buckling dome within an aperture defined through the switch housing (and engaged with the second retaining feature). In these embodiments, each chassis associated with each key assembly of the row of key assemblies may be coupled to at least one other chassis via an interconnecting portion.

In these embodiments, at least one key assembly of the row of key assemblies further includes an optical film positioned over the switch housing.

Still further embodiments described herein generally reference a keyboard including at least a housing defining a grid of apertures and a feature plate disposed within the housing. The feature plate accommodates a plurality of light emitting diodes distributed relative to each aperture of the grid of apertures. The keyboard also includes a row of key assemblies. At least one key assembly of the row of key assemblies includes a chassis coupled to the feature plate over one light emitting diode. The key assembly also includes a switch housing formed on the chassis and optically coupled to the one light emitting diode. In addition, the key assembly includes an optical film placed over the switch housing and optically coupled to the switch housing. In this manner, an optical path is formed from the light emitting diode, through the switch housing, to the optical film.

Still further embodiments described herein reference a keyboard including at least a feature plate. In these examples, a row of key assemblies is coupled to the feature plate. The row of key assemblies includes a first key assembly positioned immediately adjacent to a second key assembly. The first key assembly and the second key assembly are separated by a distance defined by an interconnecting portion. In these examples, the interconnecting portion can be removable.

BRIEF DESCRIPTION OF THE DRAWINGS

Reference will now be made to representative embodiments illustrated in the accompanying figures. It should be understood that the following descriptions are not intended to limit the disclosure to one preferred embodiment. To the contrary, it is intended to cover alternatives, modifications, and equivalents as may be included within the spirit and scope of the described embodiments as defined by the appended claims.

The use of the same or similar reference numerals in different figures indicates similar, related, or identical items.

Figure 1A:
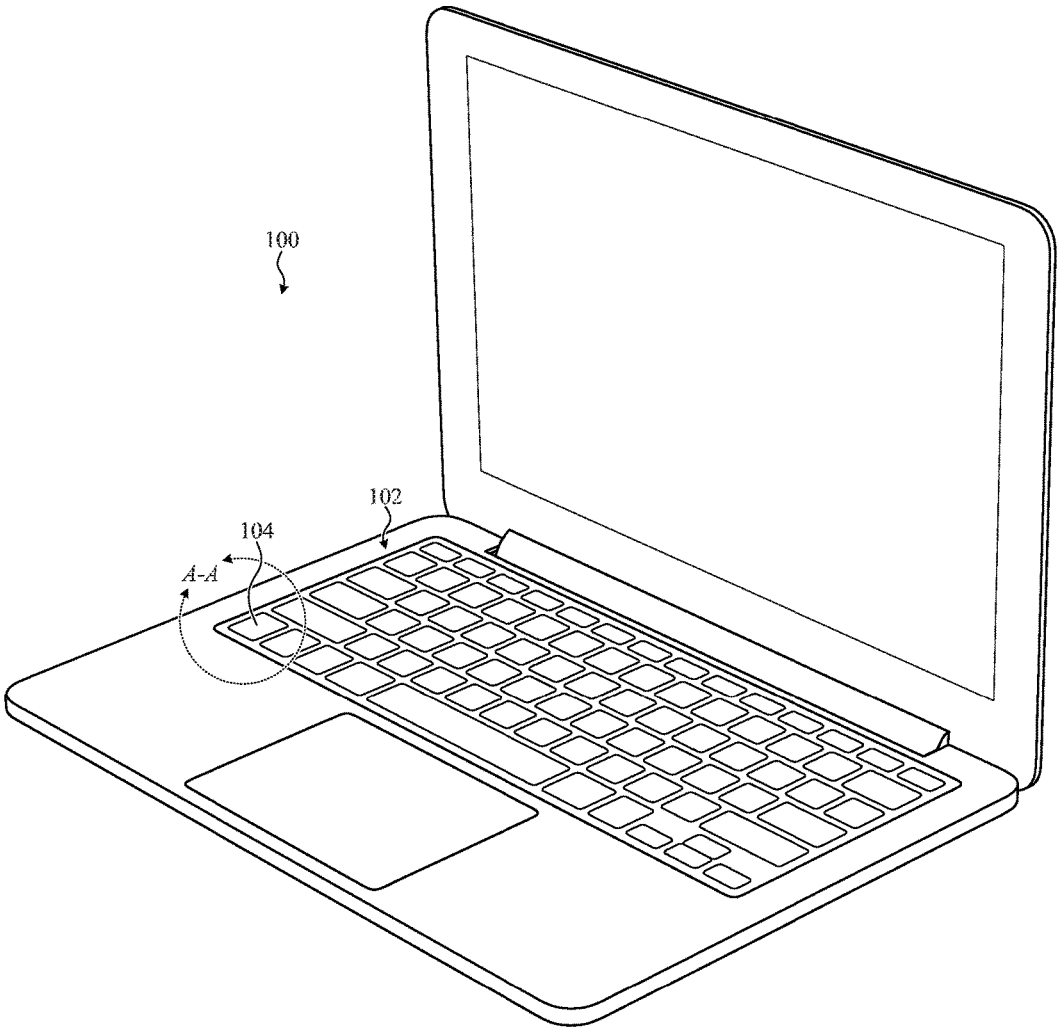
FIG. 1A depicts an electronic device incorporating a keyboard.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Embodiments described herein reference systems and methods for manufacturing keyboards with depressible keys. More specifically, many embodiments relate to methods for reliably and quickly mounting and affixing depressible key assemblies to a feature plate of a keyboard with high positional accuracy.

A keyboard, such as described herein, includes a number of depressible keys (more generally, "keys") arranged in a number of parallel and often offset rows on a substrate referred to as a "feature plate." The feature plate is a generally flat substrate that includes structural features configured to retain and support each key of the keyboard. Structural features of a feature plate can include protrusions, bosses, indentations, clips, adhesives, and so on. In addition, a feature plate accommodates electrical connections or traces for each key and control circuitry, in addition to providing structural support and rigidity to the keyboard. In typical examples, a feature plate is formed from a rigid material such as plastic, printed circuit board materials, metal layered with a dielectric coating, and so on.

The feature plate can be a single-layer or multi-layer substrate made from any number of suitable materials including, but not limited to, metal or plastic. The feature plate is typically affixed within a housing that supports and encloses the keyboard. A single keyboard may have multiple feature plates although, in many embodiments, only a single feature plate is required. Generally, each key that is coupled to the feature plate is associated with a key assembly and an electrical switch. Certain keys, especially those of large size (e.g., a space bar), may be associated with more than one key assembly and/or more than one electrical switch.

A key assembly, such as described herein, can include a number of discrete parts including, but not limited to, a keycap, a key mechanism, and a buckling dome. In some embodiments, the key assembly can also include parts or subcomponents such as backlights, light guides, optical films, color filters, pivot bars, position sensors, force sensors, touch sensors, biometric sensors, and so on. The example constructions of a key assembly provided above are not exhaustive; a key assembly such as described herein can be formed in any implementation-specific manner from any number of suitable parts or subcomponents.

Keyboards including key assemblies such as described herein can be manufactured in a number of suitable ways. However, conventional methods of manufacturing may be time consuming and/or resource intensive, or may be unsuitable for low-profile or thin keyboards.

For example, one conventional method of manufacturing a keyboard groups common parts of key assemblies into layers (e.g., a dome layer, circuit layer, membrane layer, backlight layer, support layer, and so on) that are progressively disposed onto a feature plate. Such keyboards are generally referred to herein as "layered keyboards." The use of layers may, in some cases, decrease manufacturing time or may provide for desirable relative alignment of key assemblies. However, the user of layers may increase the total thickness and weight of the keyboard. Additional thickness and weight may be undesirable for certain keyboards, especially for low-profile or portable keyboards. Furthermore, manufacturing errors or variations may accumulate with each successive layer; it may be difficult to manufacture layered keyboards with high tolerances.

For embodiments described herein, key assemblies can be attached separately onto a feature plate during manufacturing of a keyboard. These keyboards are referred to herein as "singulated keyboards." Singulated keyboards can have a total thickness and weight that is less than the total thickness and weight of a layered keyboard. More specifically, a layered keyboard includes excess material (e.g., layers) between each key assembly, whereas a singulated keyboard does not. The distance between the outer surface of a keycap and the feature plate of a singulated keyboard is less than the distance between the outer surface of a keycap and the feature plate of a layered keyboard.

Accordingly, embodiments described herein reference methods for assembling low-profile, singulated keyboards quickly and efficiently. In one embodiment, a singulated keyboard can be manufactured by fabricating each key assembly, individually, onto a feature plate using an automated assembly mechanism, such as a pick and place machine.

In further embodiments, a singulated keyboard is manufactured by prefabricating key assemblies onto a chassis strip that is divided into individual key assemblies after the chassis strip is mounted and/or affixed to a feature plate of the keyboard. In these embodiments, the chassis strip forms a portion of the structure of the key, thereby reducing the number of additional features and/or structures of the feature plate. This simplifies manufacturing and handling of the feature plate.

More particularly, a row of key assemblies can be fabricated onto a chassis strip that corresponds to a partial or complete row of keys of the keyboard. The chassis strip is thereafter mounted and/or affixed to a feature plate in a specific location, providing accurate alignment for each prefabricated key assembly on the chassis strip to a respective location on the feature plate. In these embodiments, the feature plate can be a planar substrate. As such, the feature plate does not require any particular geometry or features; the chassis of each key assembly provides structural features that engage with the various parts of the key assembly. In further embodiments, the chassis of each key assembly can provide electrical connection, define an electrical path, complete an electrical circuit, serve as a portion of an electrical circuit (e.g., resistor, capacitor, jumper, connector, interposer, and so on), serve as an electromagnetic shield, and so on. Next, each prefabricated key assembly is independently mounted and/or affixed to the feature plate. Finally, interconnecting portions of the chassis strip between the prefabricated key assemblies are removed, thereby singulating each key assembly.

In this manner, the operation of fabricating an arbitrary number of key assemblies associated with an arbitrary number of rows associated with an arbitrary number of keyboards can be performed in a continuous progressive manufacturing process. The phrase "continuous progressive manufacturing process" as used herein generally refers to any progressive manufacturing or fabrication process, or combination of processes, which can be performed, in whole or in part, by progressively adding parts to semi-finished assemblies. In some examples, an arbitrary number of key assemblies can be fabricated onto a chassis strip of arbitrary length by a single automated assembly mechanism, such as a pick and place machine. In other examples, an arbitrary number of key assemblies can be fabricated onto a chassis strip of arbitrary length by passing or conveying the chassis strip between different automated assembly mechanisms.

A continuous progressive manufacturing process may require a smaller work area, a lower average pick and place stroke length and/or time, and may provide highly accurate relative positioning and alignment of all key assemblies of a keyboard (e.g., the chassis strip can be divided into multiple rows of prefabricated key assemblies) before any of those key assemblies are permanently mounted and/or affixed to the feature plate. A manufacturing error can be corrected by separating a key assembly from a row of prefabricated key assemblies.

Similarly, the operation of accurately aligning and affixing key assemblies to a feature plate may be performed at higher speed. In particular, for embodiments described herein, an entire row of key assemblies of a keyboard can be accurately and precisely positioned and aligned in a single operation. Once mounted and/or affixed to the feature plate, interconnecting portions of the chassis strip between each prefabricated key assembly can be removed or ejected. In many cases, the chassis strip may be perforated or scored (one or more times) between the prefabricated key assemblies to facilitate removal of the interconnecting portions. In this manner, the chassis strip can be described as a panelized substrate populated with key assemblies. Depanelization of the panelized substrate is deferred until after each prefabricated key assembly is independently mounted and/or affixed to the feature plate of a keyboard. As used herein, the term "panelization" and similar phrasing refers generally to the fabrication of multiple similar or identical assemblies, circuits, structures, and so on, onto a single substrate that may be segmented or otherwise divided in a later operation (herein referred to as "depanelization") into individual and separate (herein, "singulated") assemblies, circuits, and structures.

These and other embodiments are discussed below with reference to FIGS. 1A-10. However, those skilled in the art will readily appreciate that the detailed description given herein with respect to these figures is for explanatory purposes only and should not be construed as limiting.

Figure 1B:
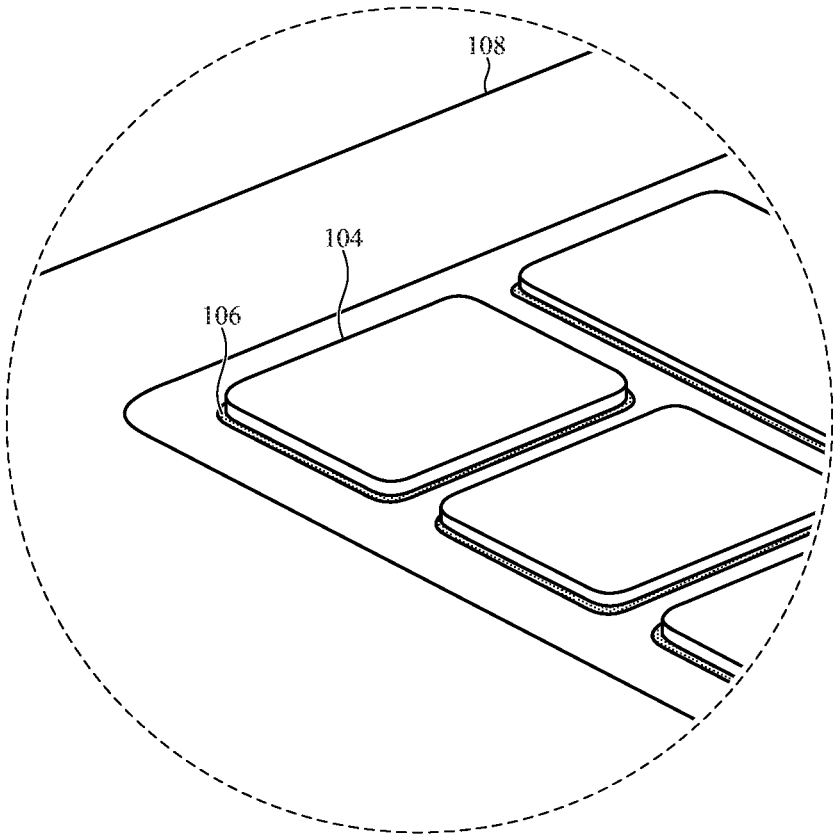
FIG. 1B depicts the enclosed circle A-A of FIG. 1A, specifically showing a key positioned relative to an aperture defined through a housing of the electronic device.

Generally and broadly, FIGS. 1A-1B reference an electronic device 100 incorporating a keyboard 102 with multiple keys. A user provides input to the electronic device 100 by pressing a key 104 of the keyboard 102. The electronic device 100 and/or the keyboard 102 may be configured to perform, schedule, monitor, or coordinate one or more operations in response to a keypress. In many cases, the keyboard 102 is a singulated keyboard such as described herein that may be manufactured using techniques such as described herein.

The keyboard 102 is illustrated as an alphanumeric keyboard integrated in a lower clamshell portion of a foldable laptop computer, although such a configuration is not required. For example, the keyboard 102 may have a different number of keys or may be arranged in another manner. In further embodiments, the keyboard 102 may be separate from the electronic device 100.

In this embodiment, each key of the keyboard 102, including the key 104, is positioned relative to an aperture defined in the lower clamshell portion of the foldable laptop computer. In many cases, the aperture is a member of a group or mesh of apertures defined through the lower clamshell portion of the foldable laptop computer. More particularly, a keycap associated with each key extends at least partially through a similarly-shaped aperture defined in the lower clamshell portion of the foldable laptop computer. As noted with respect to other embodiments described herein, each keycap accommodates an image or symbol (not shown) that corresponds to a function associated with the key that may be performed when the key is pressed by a user.

In some embodiments, the keyboard 102 need not be integrated in a lower clamshell portion of a foldable laptop computer; the keyboard may be incorporated into, for example, a cover for a tablet computer, a peripheral input device, an input panel, or any other suitable depressible button or depressible key input system.

In particular, FIG. 1A depicts the electronic device 100 incorporating the keyboard 102, which as noted above, includes a number of keys arranged in a collection of offset rows defining a grid of keys. In particular, six rows of keys are shown. One example key of the keyboard is labeled as the key 104. FIG. 1B depicts the enclosed circle A-A of FIG. 1A, specifically showing the key 104 positioned relative to an aperture 106 defined through a housing 108 of the electronic device 100. In many embodiments, an edge of the key 104 is separated by a distance d from a sidewall of the aperture 106. The distance d can vary from embodiment to embodiment. In certain cases, the distance d is substantially constant around the periphery of the key 104. It may be appreciated that for embodiments in which the distance d is particularly small, manufacturing may be challenging; accurate and precise placement of the key 104 may be accomplished using methods described herein.

The key 104 is a depressible key that includes a keycap that may be pressed by a user to provide input to the electronic device 100. In this manner, the key 104 is configured to receive user input. The keycap can be a single layer or multi-layer keycap made from any number of suitable materials or combination of materials, such as, but not limited to, plastic, glass, sapphire, metal, ceramic, fabric, and so on. In typical examples, a symbol (not shown) is accommodated on an upper surface of the keycap. In many examples, the upper surface of the keycap has a square or rectangular shape with rounded corners, although this is not required.

The electronic device 100 is depicted as a laptop computer which can include additional components such as, but not limited to, a display, a touch/force input/output device, an audio input/output device, a data or power port, a wireless communication module, and so on. It may be appreciated that, for simplicity of illustration, the electronic device 100 in FIGS. 1A-1B is depicted without many of these components, any of which may be included entirely or partially within the housing 108.

As noted with respect to other embodiments described herein, the key 104 may be associated with a key assembly and at least one electrical switch. One example of a key assembly is shown in FIGS. 2A-2M. This key assembly is identified as the key assembly 200.

As described in further detail below, a key assembly such as depicted in FIGS. 2A-2M, can include a number of discrete parts including, but not limited to, a keycap, a key mechanism, and a buckling dome. A keycap of a key assembly has an outer surface configured to receive user input. Typically, the keycap is made from plastic, glass, fabric, or metal, although other materials or combinations of materials maybe suitable in certain embodiments. For example, a keycap can include a uniform plastic or acrylic body. In another example, a keycap can include a metal, plastic, or glass body subjacent a fabric outer layer. In some cases, the fabric outer layer can overlap more than one keycap. The example constructions of a keycap provided above are not exhaustive; a keycap such as described herein can be formed from any number of suitable materials or combination of materials.

The outer surface of the keycap accommodates an image, glyph, or symbol that corresponds to a function associated with the key that may be performed (e.g., by an electronic device in communication with the keyboard) when the key is pressed the user.

A key mechanism of the key assembly is typically engaged with an underside of the keycap and with one or more support features extending from a chassis that is, in turn, affixed to the feature plate. In this manner, the key mechanism movably couples the keycap to the feature plate and facilitates a downward linear motion (or translation) of the keycap in response to a user input. The key mechanism can be a scissor mechanism, a butterfly mechanism, or any other suitable hinged, pivoting, sliding, compressing, or rotating mechanism.

A buckling dome of a key assembly such as described herein is typically positioned between the feature plate and the keycap, and above the electrical switch. In this manner, when a user input is received and the key is pressed (during a "keypress"), a force is exerted on the keycap by the user that causes the key mechanism to compress which causes the buckling dome to buckle and the electrical switch to close. When the force is removed, the buckling dome exerts a restoring force that causes the key mechanism to extend, returning the keycap to its original position, ready to receive a subsequent user input.

In many cases, the buckling dome and electrical switch are disposed within an enclosure generally referred to herein as a "switch housing." The switch housing defines an aperture that partially or entirely encloses the buckling dome and electrical switch to provide thermal, mechanical, optical, electrical, and/or chemical protection or features to the electric switch and buckling dome, promoting a consistent and reliable user experience of operating the associated key. It may be appreciated that the example construction of a switch housing provided above is not exhaustive; a switch housing such as described herein can be formed or fabricated in any implementation-specific manner from any number of suitable parts or subcomponents.

Figure 2A:
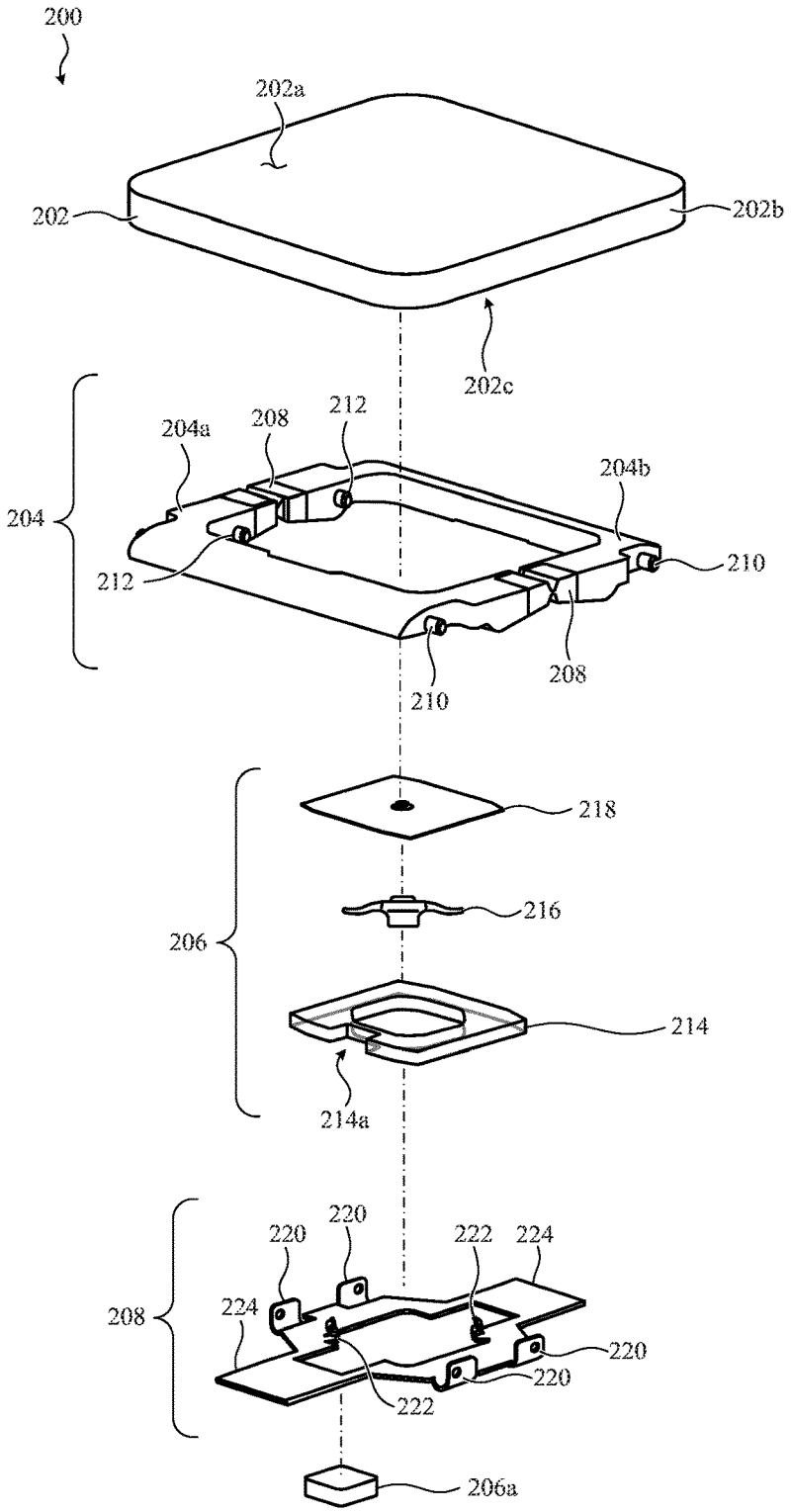
FIG. 2A depicts an exploded view of one example of a key assembly that may be fabricated when manufacturing a keyboard, such as the keyboard depicted in FIGS. 1A-1B.
Figure 2B:
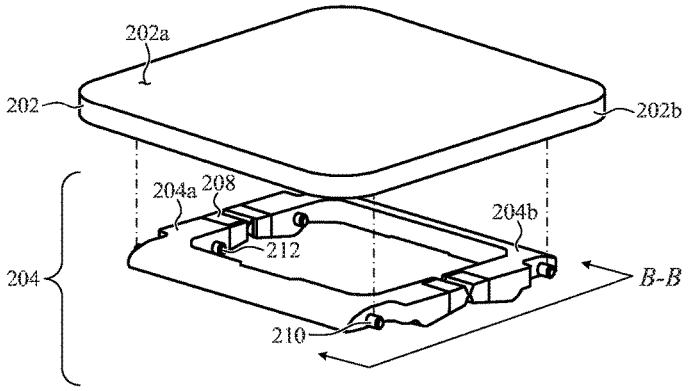
FIG. 2B depicts a detailed assembly view of a keycap and a key mechanism associated with the key assembly depicted in FIG. 2A.
Figure 2C:
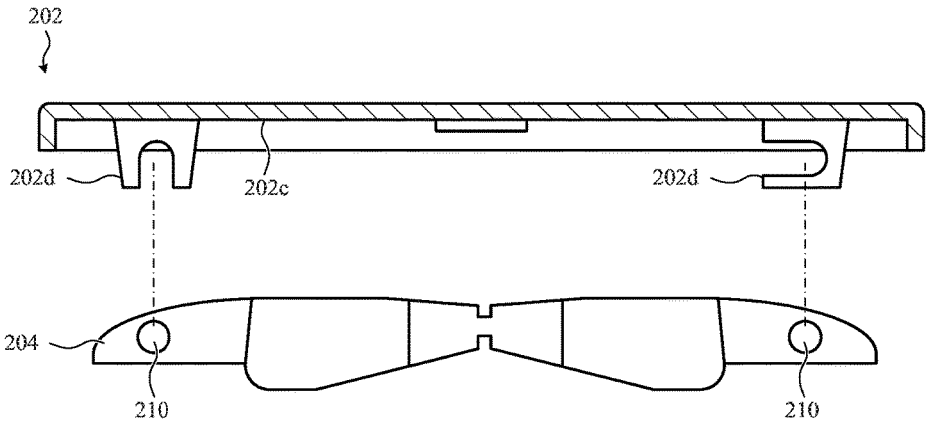
FIG. 2C depicts a cross-section view through line B-B of the keycap and key mechanism of FIG. 2B.

More particularly, FIG. 2A depicts an exploded view of one example of a key assembly 200 that may be fabricated onto a chassis which is affixed to a feature plate of a keyboard, such as the keyboard depicted in FIGS. 1A-1B.

The key assembly 200 includes a keycap 202, a key mechanism 204, and a switch structure 206 that are interconnected and coupled to a chassis 208. The chassis 208 can be used as a carrier to affix the entire key assembly 200 onto a feature plate of a singulated keyboard. In this manner, one or more structural, electrical, and/or support functions that may have been provided by a conventional feature plate are accomplished by the chassis 208 itself; this structure reduces the complexity of the feature plate and increases the speed and precision with which the singulated keyboard can be manufactured.

Further, as noted above, the chassis 208 may be formed in a strip or chain with an arbitrary number of other chassis (not shown in FIGS. 2A-2M) associated with an arbitrary number of other key assemblies. The distance between the chained chassis can correspond to the distance between keys of a singulated keyboard. Once a suitable number of key assemblies are fabricated onto the various chassis of the chassis strip, the chassis strip (now corresponding to a row of keys of a singulated keyboard) can be affixed to a feature plate. In this manner, the operation of providing alignment for key assemblies on a feature plate and the operation of fabricating key assemblies can be performed in parallel.

The keycap 202 of the key assembly 200 is shown in greater detail in FIGS. 2B-2E. The keycap 202 has a generally square or rectangular shape, defined by an upper surface 202*a* and a sidewall 202*b* that extends in a generally continuous manner around the periphery of the upper surface 202*a*.

A symbol, legend, letter, or number (not shown) can be accommodated on the upper surface 202*a*. As noted with respect to other embodiments described herein, the symbol can correspond to a function to be performed by a keyboard incorporating the key assembly 200. In some cases, the symbol (or a negative thereof) is printed on the upper surface 202*a*. In other cases, the symbol can be outlined by one or more apertures defined through the keycap 202. In these cases, the aperture(s) may be filled with a transparent or translucent material (such as epoxy, glass, plastic, and so on) to facilitate backlighting of the keycap 202.

For example, the aperture may be formed through the upper surface 202*a* by laser ablation and/or laser etching. In a subsequent operation, the aperture may be filled with a semi-transparent epoxy. In another example, the aperture may be defined during manufacturing of the keycap 202.

The keycap 202 can be made from any number of suitable materials or combination of materials including, but not limited to, metal, glass, plastic, ceramic, fabric, and so on. The keycap 202 can be partially or completely transparent, opaque, or translucent. In many cases, the keycap 202 is formed from a single material, but this may not be required. For example, the material(s) selected for the upper surface 202*a* may be different than the material(s) selected for the sidewall 202*b*. The upper surface 202*a* can be substantially flat, although this is not required. In an alternate embodiment, the upper surface 202*a* has a partially concave shape that can contour to a user's finger.

In many cases, the keycap 202 includes retaining features on a lower surface 202*c*. The lower surface 202*c* can be opposite the upper surface 202*a*, and can be partially or entirely enclosed by the sidewall 202*b*.

The retaining features associated with a particular keycap can vary from embodiment to embodiment. Two example configurations of retaining features are identified in FIG. 2C as the retaining features 202*d*. The retaining features 202*d* extend from the lower surface 202*c*. Each retaining feature includes a channel configured to interlock with, and/or couple to, one or more portions of the key mechanism 204. As shown, the channel(s) can be formed in any number of suitable ways; one retaining feature is depicted with a downward-oriented channel whereas another is depicted with a horizontally-oriented channel. It may be appreciated that the orientation of either or both retaining features can be modified in any implementation-specific or appropriate manner. In other embodiments, the retaining features 202*d* can include an aperture or through-hole or the retaining features 202*d* can be defined on an interior surface of the sidewall 202*b*.

The key mechanism 204 of the key assembly 200 is illustrated as a butterfly mechanism, although this may not be required. For example, the key mechanism 204 can be a scissor mechanism, a geared mechanism, or any other suitable hinged, pivoting, sliding, or rotating mechanism. In the illustrated embodiment, the key mechanism 204 is defined by two symmetrical wings, a first wing 204*a* and a second wing 204*b*, separated by a living hinge, identified as the hinge 206*c*. The hinge 206*c* is connected to each of the first wing 204*a* and the second wing 204*b*; the hinge 206*c* facilitates folding of the wings about an axis generally perpendicular to the direction along which the key assembly 200 compresses in response to a keypress.

Figure 2D:
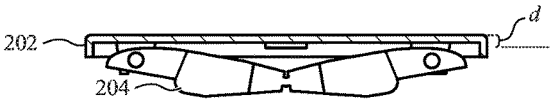
FIG. 2D depicts the keycap and key mechanism of FIG. 2B, assembled.
Figure 2E:
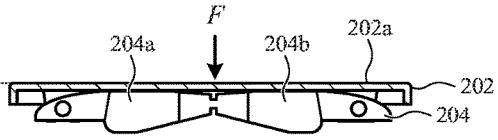
FIG. 2E depicts the keycap and key mechanism of FIG. 2C compressed in response to a force exerted on an upper surface of the keycap.
Figure 2F:
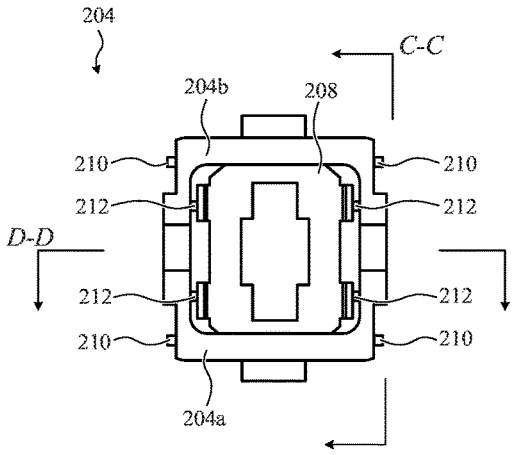
FIG. 2F depicts a top view of the key mechanism depicted in FIGS. 2A-2D.
Figure 2G:
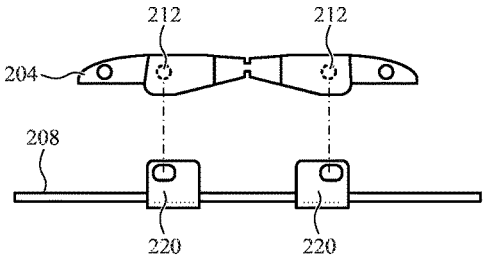
FIG. 2G depicts a cross-section view through line C-C of the key mechanism FIG. 2F, positioned over a chassis associated with the key assembly of FIG. 2A.
Figure 2H:
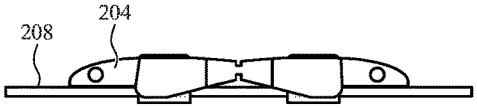
FIG. 2H depicts the key mechanism of FIG. 2G, assembled onto the chassis.
Figure 2I:
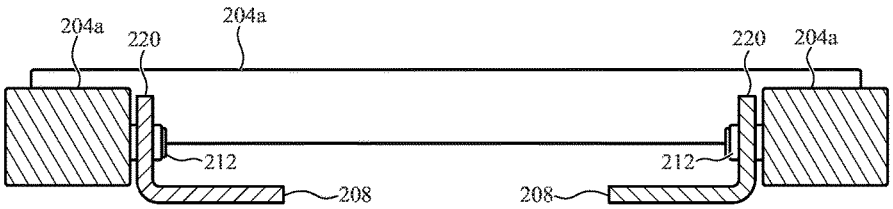
FIG. 2I depicts a cross-section view through line D-D of the key mechanism of FIG. 2F.

An example fold of the first wing 204*a* and the second wing 204*b* along the hinge 206*c* is depicted in FIGS. 2D-2E. In particular, FIG. 2D illustrates the keycap 202 in an upward position, showing the key mechanism 204 in an extended position. FIG. 2E illustrates the keycap 202 receiving a user input in the form of a force F exerted on the upper surface 202*a*, which causes the first wing 204*a* and the second wing 204*b* of the key mechanism 204 to fold, thereby lowering the keycap 202 a distance d downwardly in response to the user input.

The first wing 204*a* and the second wing 204*b* are illustrated with substantially the same half-rectangle shape, symmetrically mirrored across the hinge 206*c*. As a result, the key mechanism 204 has a generally rectangular shape when viewed from above. The first wing 204*a* and the second wing 204*b* may be made from any number of suitable materials, but in many embodiments, the first wing 204*a* and the second wing 204*b* are made from a rigid material such as a glass-filled polymer. Other suitable materials can include, but are not limited to, glass, plastic, metal, epoxy, acrylic, and so on. In many cases, the first wing 204*a* and the second wing 204*b* are made from the same material or combination of materials, but this is not required. The first wing 204*a* and the second wing 204*b* can be made to be partially or entirely optically transparent or translucent.

In one embodiment, the hinge 206*c* is a fabric or polymer material molded onto or between the first wing 204*a* and the second wing 204*b*. In other examples, the hinge 206*c* is an elastomer overmolded on the first wing 204*a* and the second wing 204*b*. In still further examples, the hinge 206*c* can be formed in another manner.

The first wing 204*a* and the second wing 204*b* can include one or more outwardly-facing pins configured to interlock with the retaining features 202*d* of the keycap 202 (see, e.g., FIGS. 2B-2E). More specifically, the first wing 204*a* and the second wing 204*b* each include at least one keycap pin, such as the keycap pin 210. In the embodiment shown in FIGS. 2A-2E, four keycap pins are shown. Although the keycap pins are illustrated as outwardly-facing pins having a generally cylindrical shape, this may not be required; some embodiments include inwardly-facing pins and/or pins having a different shape, such as an oblong or elliptical shape.

The first wing 204*a* and the second wing 204*b* can also include one or more inwardly-facing pins configured to interlock with pivot points defined in the chassis 208 of the keycap 202 (see, e.g., FIGS. 2F-2I). In other embodiments, the pivot points may be defined in the switch structure 206. More specifically, the first wing 204*a* and the second wing 204*b* each include at least one pivot pin, such as the pivot pin 212. In the embodiment illustrated in FIGS. 2A-2I, four pivot pins are shown. Although the pivot pins are illustrated as inwardly-facing pins having a generally cylindrical shape, this may not be required; some embodiments include outwardly-facing pivot pins and/or pivot pins having a different shape. The pivot pins couple the key mechanism 204 to the switch structure 206 and/or the chassis 208. In this manner, the key mechanism 204 can collapse in response to a keypress, drawing the keycap 202 downwardly, over the switch structure 206.

In the embodiment illustrated in FIG. 2A and shown in detail in FIGS. 2J-2M, the switch structure 206 of the key assembly 200 includes a switch housing 214, a buckling dome 216, and an optical film 218. The switch structure 206 is positioned within the key mechanism 204, as shown in FIG. 2A.

The switch housing 214 of the switch structure 206 can enclose an electrical switch (not shown). In many cases, the buckling dome 216 forms a part of the electric switch. For example, the buckling dome 216 can establish an electrical connection between adjacent electrically-conductive pads by contacting the electrically conductive pads. In another case, the buckling dome 216 can contact an electrically conductive pad, thereby completing an electrical path.

Figure 2J:
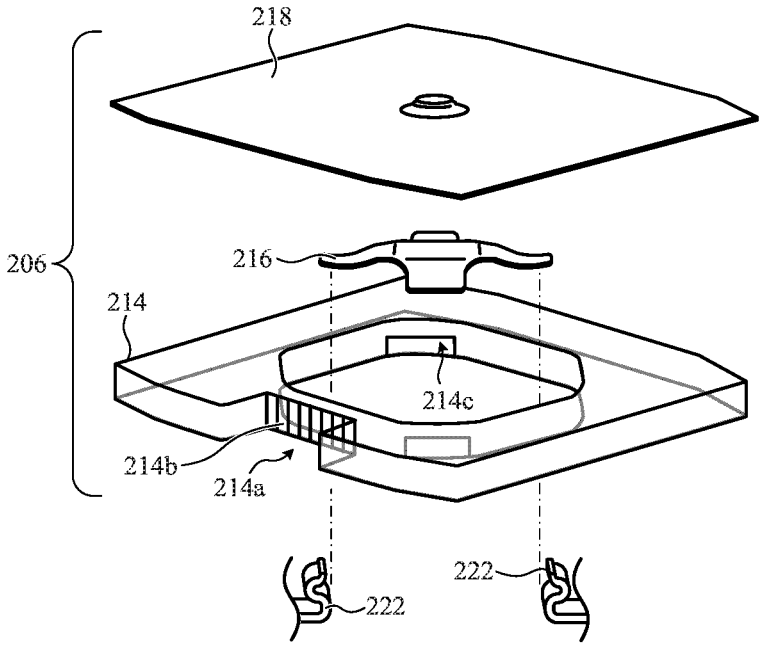
FIG. 2J depicts a detailed assembly view of a switch housing, a buckling dome, and an optical film associated with the key assembly depicted in FIG. 2A.
Figure 2K:
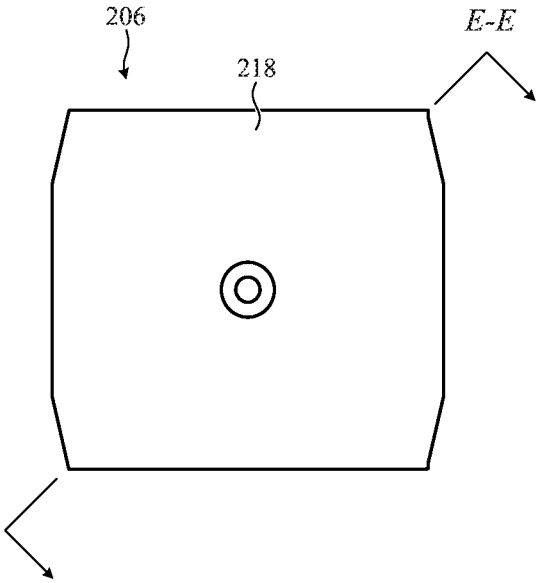
FIG. 2K depicts a top view of the switch housing, the buckling dome, and the optical film of FIG. 2J, assembled.

It may be desirable to enclose the electrical switch in order to prevent contaminants from interfering with the consistent operation of the electrical switch. In many cases, the switch housing 214 can also be a light guide. The switch housing 214 can be made from an optically transparent or translucent material such as, but not limited to, glass or plastic. In some examples, one or more sidewalls or external faces of the switch housing 214 may include a light guide feature. For example, a sidewall of the switch housing 214 may be serrated and/or formed with one or more micro-lens patterns to improve light transmission from a light source 206*a* through the switch housing 214 and toward the lower surface 202*c* of the keycap 202. In many examples, the light source 206*a* is a light emitting diode and is positioned within a channel or pocket defined in the switch housing 214, such as the pocket 214*a*. An example micro-lens pattern is shown in FIG. 2J within the pocket 214*a* and is identified as the lens 214*b*. In some cases, the light source 206*a* (or any other suitable electrical circuit) can be formed into or otherwise coupled to the chassis 208.

The buckling dome 216 of the switch structure 206 can provide a tactile feedback to the user in response to a keypress and can provide a restoring force to the key mechanism 204 to cause the keycap 202 to return to an upward position. In one embodiment, the buckling dome 216 has a cross shape (such as illustrated), having four ends extending from a central portion. The four extending ends may be formed to a particular side profile in order to provide a specific tactile feedback effect and/or restoring force effect. For example, the four extending ends may be formed with a curved side profile that provides a substantially linear tactile feedback effect.

In other cases, the buckling dome 216 can have another shape such as, but not limited to, a circular shape, a circular shape with cutouts, a square shape, a square shape with cutouts, a triangular shape, a hub-and-spoke shape and so on. The buckling dome 216 of the switch structure 206 can also be a portion of the electrical switch. The buckling dome 216 can be positioned within the switch housing 214 and can be coupled to a retaining feature of the chassis 208, described in further detail below. In many cases, the retaining feature(s) define a notch into which one or more portions of the buckling dome 216 may be positioned. In further embodiments, the switch housing 214 can define one or more upstops 214*c* that are configured to accommodate a portion of the buckling dome 216.

The optical film 218 of the switch structure 206 can be positioned over the buckling dome 216 and over the switch housing 214. In this manner the optical film 218 and the switch housing 214 cooperate to, partially or completely, seal or enclose the buckling dome 216 within the switch housing 214. This can prevent contaminants from interfering with the operation of the buckling dome 216.

The optical film 218 can include one or more dimples (one is shown) configured to interface the lower surface 202*c* of the keycap 202 or another feature of the keycap 202. The optical film 218 can be made from any number of suitable materials including, but not limited to, elastomers, polymers, fabrics, and so on. The optical film 218 can be coupled to the switch housing 214 with an adhesive such as silicone glue. In some cases, the optical film 218 and/or the switch housing 214 include a pressure vent (not shown) to normalize pressure within the switch housing 214 and the ambient environment. In some cases, the size of the pressure vent is selected in order to provide a specific tactile feedback effect, a particular acoustic profile, and/or restoring force effect.

In some embodiments, the optical film 218 is formed entirely or in part from an optically translucent or optically transparent material. The optical film 218 can have similar optical properties to the switch housing 214, although this may not be required. The optical film 218 is configured to receive light emitted from the switch housing 214, or from below the switch housing 214. The optical film 218 can be configured to direct light (e.g., with serrations, lenses, or other) toward the lower surface 202*c* of the keycap 202. In some cases, the optical film 218 can include a mask layer that blocks light from exiting the optical film 218 in certain regions, while permitting light from exiting the optical film 218 in other regions.

In the illustrated embodiment, the chassis 208 of the key assembly 200 is a metal substrate that is formed to define several retaining features such as a key mechanism retaining feature 220 and a buckling dome retaining feature 222.

In the embodiment illustrated in FIGS. 2A and 2J-2M, four key mechanism retaining features are depicted and two buckling dome retaining features are depicted, although other embodiments may be implemented in another manner.

Each key mechanism retaining feature 220 is configured to engage with one respective pivot pin 212 of the key mechanism 204 (see, e.g., FIGS. 2F-2I). In this manner, the key mechanism retaining features define pivot points for the pivot pins of the key mechanism 204. In many cases, the key mechanism retaining features are formed by bending tabs of the chassis 208.

Figure 2L:
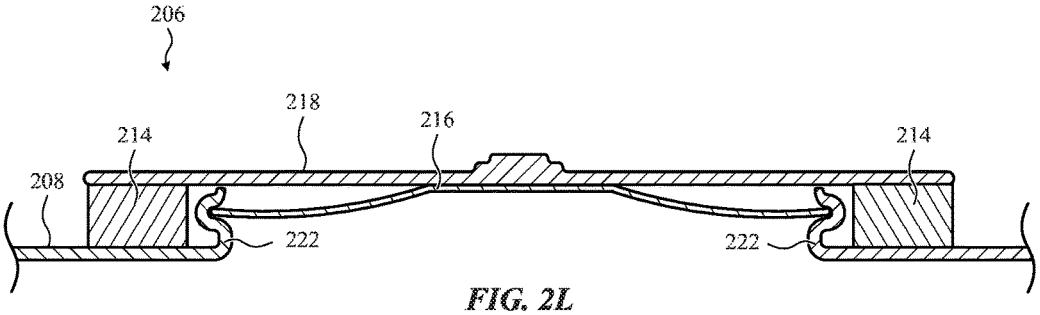
FIG. 2L depicts a cross-section view through line E-E of the switch housing, the buckling dome, and the optical film of FIG. 2K.
Figure 2M:
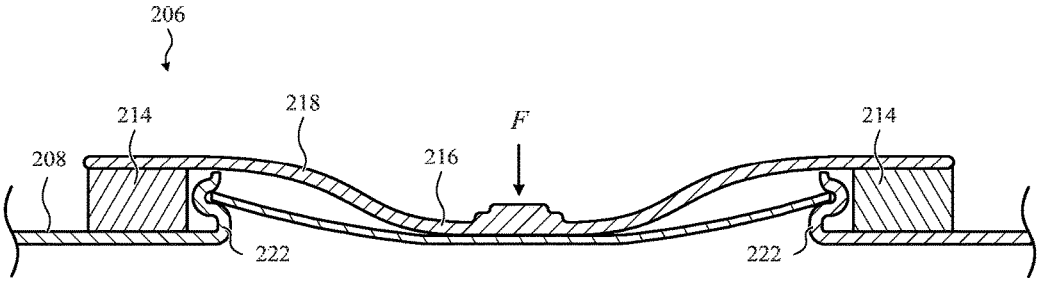
FIG. 2M depicts the switch housing, the buckling dome, and the optical film of FIG. 2H compressed in response to a force exerted on the optical film.

Each buckling dome retaining feature is configured to engage with one respective end or portion of the buckling dome 216 (see, e.g., FIGS. 2J-2M). For example, the buckling dome retaining feature 222 can include a notch and/or a spring arm that is configured to engage (e.g., by snapping) with one or more features of the buckling dome 216. The size and/or shape of the buckling dome retaining feature 222 can affect the positioning and/or travel distance of the buckling dome 216 within the switch housing 214. In many cases, the buckling dome retaining features are formed by bending tabs of the chassis 208. In some embodiments, the buckling dome retaining features are formed as a spring and are configured to bend or flex in response to a keypress or actuation of the buckling dome 216. As an example, FIGS. 2L and 2M are presented showing bending of the buckling dome 216 and the buckling dome retaining features 222 in response to a force exerted on the optical film 218. In this example, the buckling dome 216 and the buckling dome retaining features 222 cooperate to provide a particular tactile feedback to a user. In this embodiment, the buckling dome retaining features 222 are configured to bend, flex, and/or retract in response to an actuation of the buckling dome 216. In many cases, this provides a degree of overload protection to the buckling dome 216, thereby extending the operational life of the buckling dome 216.

The chassis 208 also includes tabs 224 that may be used to position and/or place the key assembly on a feature plate of a keyboard. In other cases, the tabs 224 may be used to electrically couple the chassis 208 to a contact pad on a feature plate of a keyboard. Such an electrical coupling can also electrically couple the buckling dome 216, via the buckling dome retaining feature 222, to the contact pad.

In many embodiments, a key assembly such as the key assembly 200 can be fabricated with other key assemblies onto a chassis strip that defines a linear series of chassis, such as the chassis 208. In this example, the chassis strip can be formed from metal and can define a row of chassis suitable for fabricating a row of key assemblies that corresponds to a row of keys of a keyboard.

Generally and broadly, FIGS. 3A-3G depict a chassis strip (e.g., a chain of chassis) that can be populated with a number of key assemblies, such as the key assembly 200 depicted in FIGS. 2A-2M. The chassis strip may be made from any number of suitable materials, but in many embodiments, the chassis strip is formed from metal, such as sheet metal (e.g., stainless steel). Other materials can include, but are not limited to, plastic, acrylic, glass, ceramic, nylon, and so on.

The process of fabricating multiple key assemblies onto a chassis strip may occur progressively in stages. FIGS. 3A-3G are provided to illustrate intermediate stages of one example process of fabricating multiple key assemblies onto a chassis strip, although it is appreciated that the order presented herein is not required. Similarly, additional or fewer operations may be performed in particular implementations.

Figure 3A:
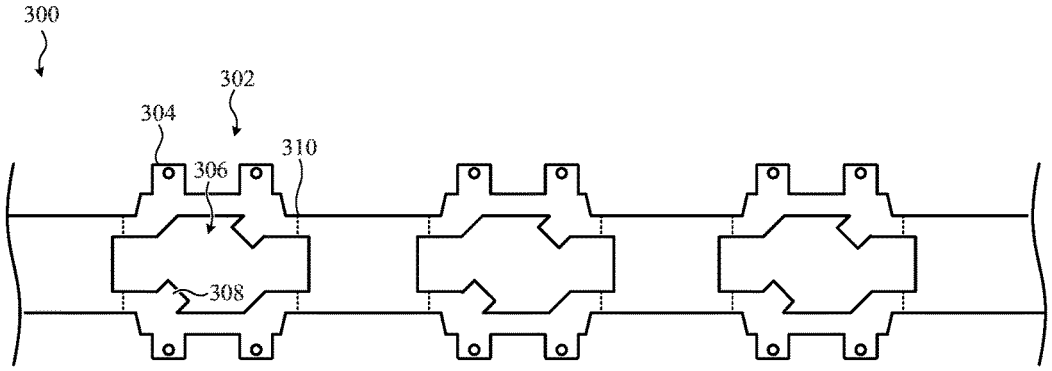
FIG. 3A depicts a top view of a chassis strip that can be used to fabricate multiple key assemblies such as the key assembly depicted in FIGS. 2A-2M.

FIG. 3A depicts a top view of a chassis strip that can be used to fabricate multiple key assemblies such as the key assembly depicted in FIGS. 2A-2M. The chassis strip 300 is formed to define a series chassis configured to be populated by a series of key assemblies. The chassis strip 300 can be formed from any number of suitable materials, although in many embodiments, it is formed from a sheet of stamped metal such as aluminum or stainless steel.

The chassis strip 300 in the illustrated embodiment defines three chassis, one of which is labeled as the chassis 302. The chassis strip 300 can have any suitable length. The spacing between the various chassis defined by the chassis strip 300 can be regular or irregular.

The chassis 302 defines four key mechanism retaining features, one of which is labeled as the key mechanism retaining feature 304. Generally, the key mechanism retaining features extend outwardly from a centerline of the chassis 302 through a central cutout region 306. The key mechanism retaining features are configured to receive and/or accommodate pins extending from a key mechanism, such as the pivot pin 212 that extends from the key mechanism 204 in FIGS. 2A-2M.

In addition, the chassis 302 defines two buckling dome retaining features, one of which is labeled as the buckling dome retaining feature 308. The chassis strip 300 also includes one or more breakaway features that may be used to separate the interconnecting portions from the chassis strip 300. In the present example, the breakaway features can include a perforation 310, but may also include a score, a channel, or other feature that is configured to facilitate a break or separation of the material of the chassis strip 300. In other examples, more than one breakaway feature can be used. The perforation 310 can be used to separate one chassis from an adjacent chassis. In some embodiments, the perforation 310 may not be required or may be positioned in another location different from that shown. In still further cases, adjacent chassis can be separated by more than two perforations; in some cases, different perforations can have different breakaway characteristics.

The central cutout region 306 may be sized to accommodate an electrical switch or circuit on a feature plate of a keyboard. In other cases, the central cutout region 306 may be sized to accommodate a light emitting element such as a light emitting diode.

Generally, the buckling dome retaining features extend inwardly into the central cutout region 306 and are configured to accommodate and support a buckling dome, such as the buckling dome 216 depicted in FIGS. 2A-2M. Collectively, the key mechanism retaining features and the buckling dome retaining features are referred to herein as "retaining features." The retaining features can be formed with detent recesses or through-holes that define pivot points for other parts of the key assemblies. For example, the four key mechanism retaining features are depicted in FIG. 3A with through-holes configured to accommodate four corresponding pins that extend from a key mechanism, such as the pivot pin 212 that extends from the key mechanism 204 depicted in FIGS. 2A-2M.

Figure 3B:
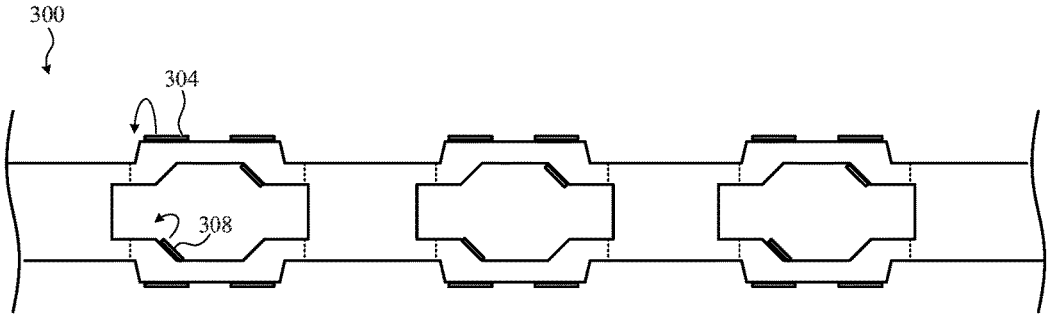
FIG. 3B depicts the chassis strip of FIG. 3A, particularly showing portions of the chassis strip folded to form structural features configured to engage with and support parts of each fabricated key assembly.

In many embodiments, the retaining features of the chassis 302 can be reoriented (e.g., bent, flexed, stamped, formed, folded, and so on) in a direction generally perpendicular to the plane of the chassis 302, such as shown in FIG. 3B. This operation orients the retaining features so as to accommodate other parts of the key assemblies, such as a key mechanism or a buckling dome. In some embodiments, the retaining features can be reoriented, bent, or otherwise formed to a particular side profile. The side profile of the retaining features may be the same or different, and may vary from embodiment to embodiment.

Figure 3C:
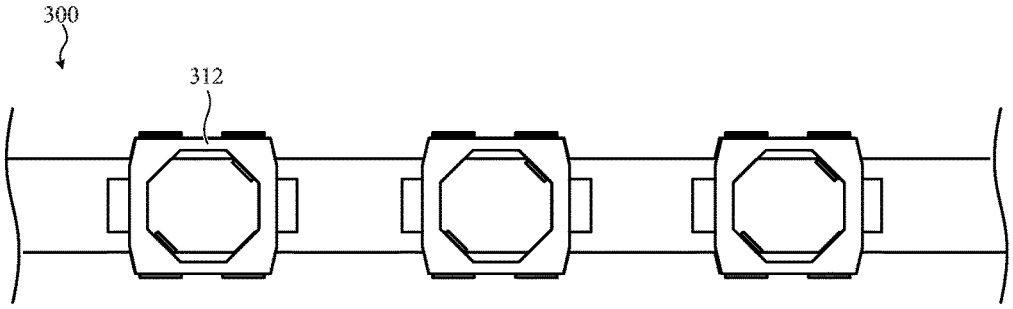
FIG. 3C depicts the chassis strip of FIG. 3B, particularly showing multiple switch housings formed onto the chassis strip adjacent to the structural features formed as shown in FIG. 3B.
Figure 3D:
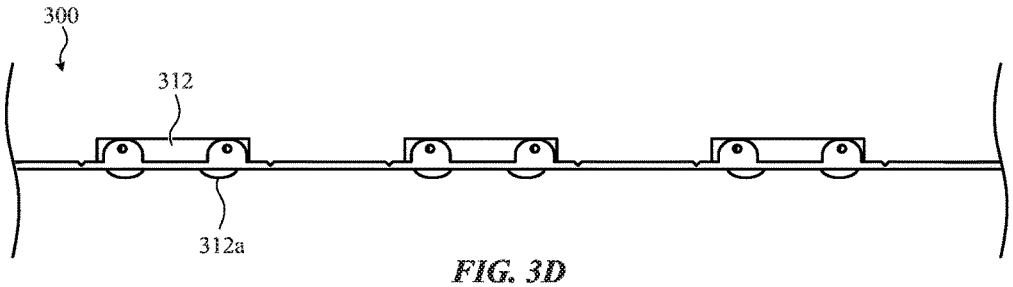
FIG. 3D depicts a side view of the chassis strip of FIG. 3C, particularly showing the chassis strip as an insert within the switch housings that are formed using an insert molding process.

Once the retaining features are formed as shown in FIG. 3B, or in any other suitable or implementation-specific orientation, a switch housing 312 (such as the switch housing 214 of the key assembly 200 depicted in FIG. 2) can be attached to the chassis 302, such as shown in FIG. 3C. The switch housing 312 can be attached to the chassis 302 using any suitable method such as, but not limited to, overmolding, insert molding, adhering, welding, soldering, heat-staking via through-holes (not shown) defined in the chassis 302, and so on. For example, in one embodiment the chassis strip 300 can be an insert in an insert molding process that forms each switch housing at substantially the same time, such as shown in FIG. 3D. In this example, the chassis strip 300 can include through-holes (not visible in FIG. 3D) through which a portion 312*a* of the switch housing 312 can extend, permanently attaching the switch housing 312 to the chassis strip 300.

Figure 3E:
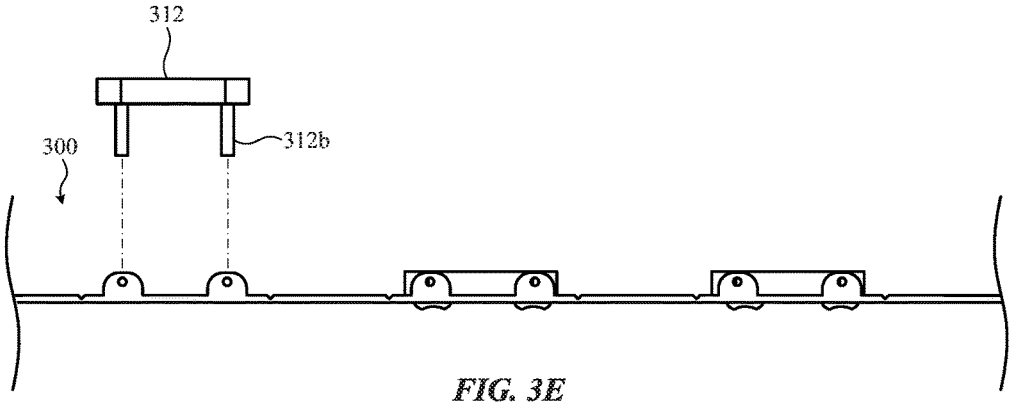
FIG. 3E depicts a side view of the chassis strip of FIG. 3C, particularly showing the switch housings heat staked to the chassis strip.

In another example, each switch housing can be overmolded onto the chassis strip 300, such as shown in FIG. 3E. In this example, the chassis strip 300 can include through-holes (not visible in FIG. 3D) through which a portion 312*b* of the switch housing 312 can extend. Before, during, or after the portion 312*b* is cured, it may be pressed against the chassis strip 300 to permanently attach the switch housing 312 to the chassis strip 300. In other cases, the portion 312*b* can be heat staked.

It may be appreciated that the example methods of forming the switch housing(s) onto the chassis strip 300 provided above are not exhaustive and are merely examples; other suitable or implementation-specific methods of forming and/or affixing one or more switch housings to a chassis strip 300 such as described herein can be used.

The switch housing 312 can be made from a material such as, but not limited to, polymers, elastomers, glasses, metals, and so on. In many embodiments the switch housing 312 is optically transparent or translucent.

Figure 3F:
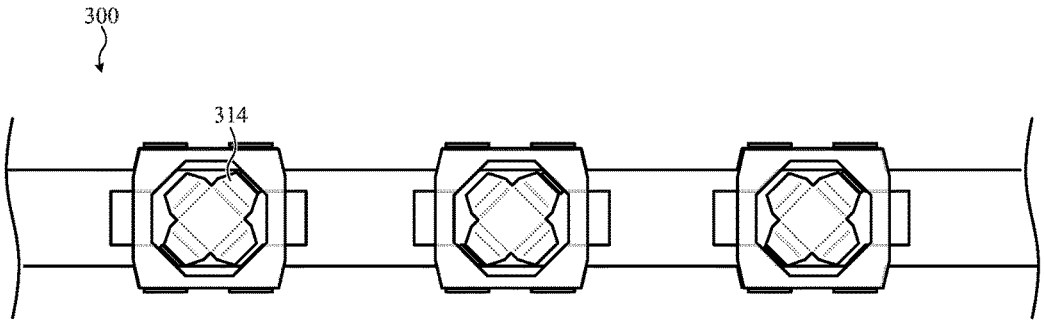
FIG. 3F depicts the chassis strip of FIG. 3C, particularly showing a buckling dome engaged with the structural features of the chassis strip formed as shown in FIG. 3B.

Once the switch housing 312 is formed onto the chassis 302, a buckling dome 314 can be positioned within the switch housing 312, over the central cutout region 306, and between the two buckling dome retaining features, such as depicted in FIG. 3F. In many cases, the buckling dome 314 is snap fit into the buckling dome retaining features of the chassis 302. In some cases, the buckling dome 314 can be welded, soldered, or adhered to the buckling dome retaining features of the chassis 302, although this may not be required. As noted with respect to other embodiments described herein, the buckling dome 314 can be made from any number of suitable materials including, but not limited to, metal and plastic. Similarly, the buckling dome 314 can be configured to take any suitable shape.

Figure 3G:
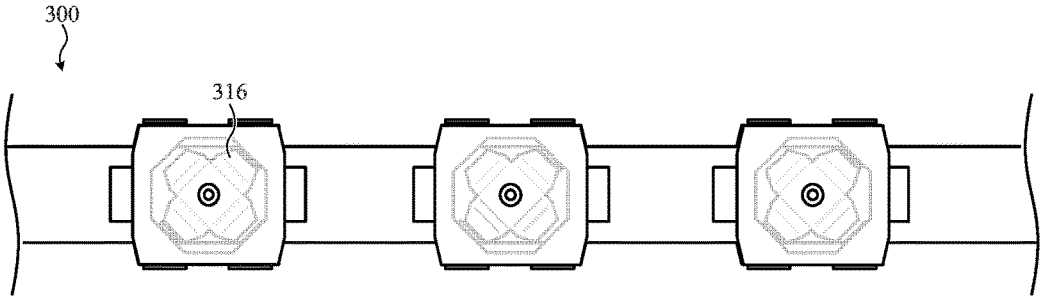
FIG. 3G depicts the chassis strip of FIG. 3F, particularly an optical film positioned over the switch housings shown in FIG. 3F.

Thereafter, once the buckling dome 314 is positioned within the switch housing 312, an optical film 316 can be positioned over the switch housing 312, such as depicted in FIG. 3G. As noted with respect to other embodiments described herein, the optical film 316 can cooperate with the switch housing 312 to form an optical path from a light emitter to a keycap positioned over the key assembly. As such, the optical film 316 is typically made from an optically clear or optically translucent material although, in certain embodiments, this may not be required. The optical film 316 can be adhered to the switch housing 312, formed onto the switch housing 312 (e.g., overmolding, insert molding, etc.), heat staked into the switch housing 312, or can be affixed to the switch housing 312 using any other suitable technique.

Thereafter, a key mechanism 318 can be positioned over the switch housing 312, such as depicted in FIG. F. Thereafter, the chassis strip 300 can be referred to as a chassis strip with a number of "prefabricated" key assemblies. The strip is identified in FIG. 3H as the chassis strip with prefabricated key assemblies 320.

Figure 3H:
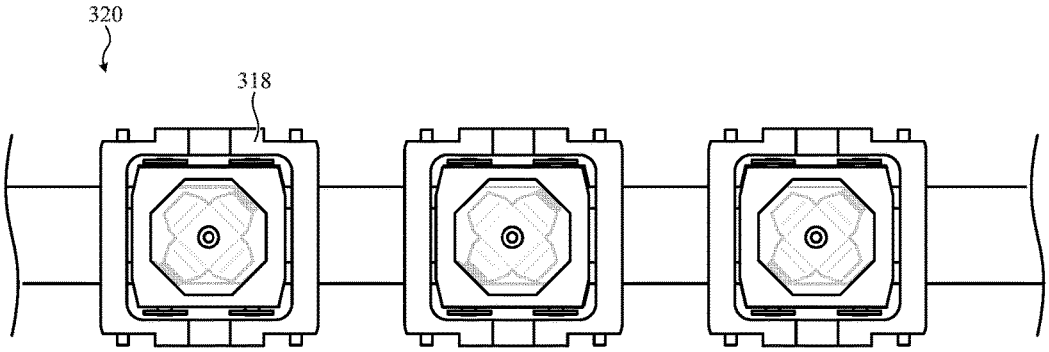
FIG. 3H depicts the chassis strip of FIG. 3G, particularly showing a key mechanism engaged with the structural features of the chassis strip formed as shown in FIG. 3B.

As noted above, a chassis strip with prefabricated key assemblies 320, such as shown in FIG. 3H, can be formed to any suitable length. In some examples, a chassis strip can include prefabricated key assemblies corresponding to a partial or complete row of keys of a keyboard. In other examples, a single chassis strip can include prefabricated key assemblies corresponding to all keys of a keyboard, spaced in an implementation-specific and/or keyboard-specific manner. Prior to affixing and/or mounting the various prefabricated key assemblies to a feature plate of the keyboard (using methods such as described herein), the single chassis strip can be separated into smaller chassis strips, each smaller chassis strip corresponding to a partial or complete row of keys of the keyboard.

The chassis strip with prefabricated key assemblies 320 can be tested before subsequent manufacturing operations are performed. Tests can include, but are not limited to, function and/or strength tests of each prefabricated key assembly, force-response tests of each prefabricated key assembly, spot function tests of one or more prefabricated key assembly, defect inspection tests, dimension and/or tolerance tests, and so on. The tests can be conducted in any suitable manner. If a prefabricated key assembly fails a test, the prefabricated key assembly can be repaired, or removed from the chassis strip; remaining prefabricated key assemblies on the chassis strip can be affixed and/or mounted to a feature plate of a keyboard using methods such as described herein. In some embodiments, testing of the prefabricated key assemblies may not be required.

Once a suitable number of key assemblies are fabricated (and/or tested) on the chassis strip, the chassis strip can be affixed and/or mounted to a feature plate of a keyboard. As noted above, the chassis strip may be associated with a particular row of keys of a keyboard. In this example, the chassis strip may be affixed to a specific location of the feature plate, thereby aligning each prefabricated key assembly to a respective location on the feature plate. Next, each prefabricated key assembly is independently mounted and/or affixed to the feature plate. Finally, interconnecting portions of the chassis strip between the prefabricated key assemblies are removed, thereby singulating each key assembly. In some cases, a chassis strip can extend between more than one feature plate of more than one keyboard. In this example, multiple keyboards can be manufactured substantially simultaneously. It is with respect to these embodiments that FIGS. 4A-4D are provided.

Figure 4A:
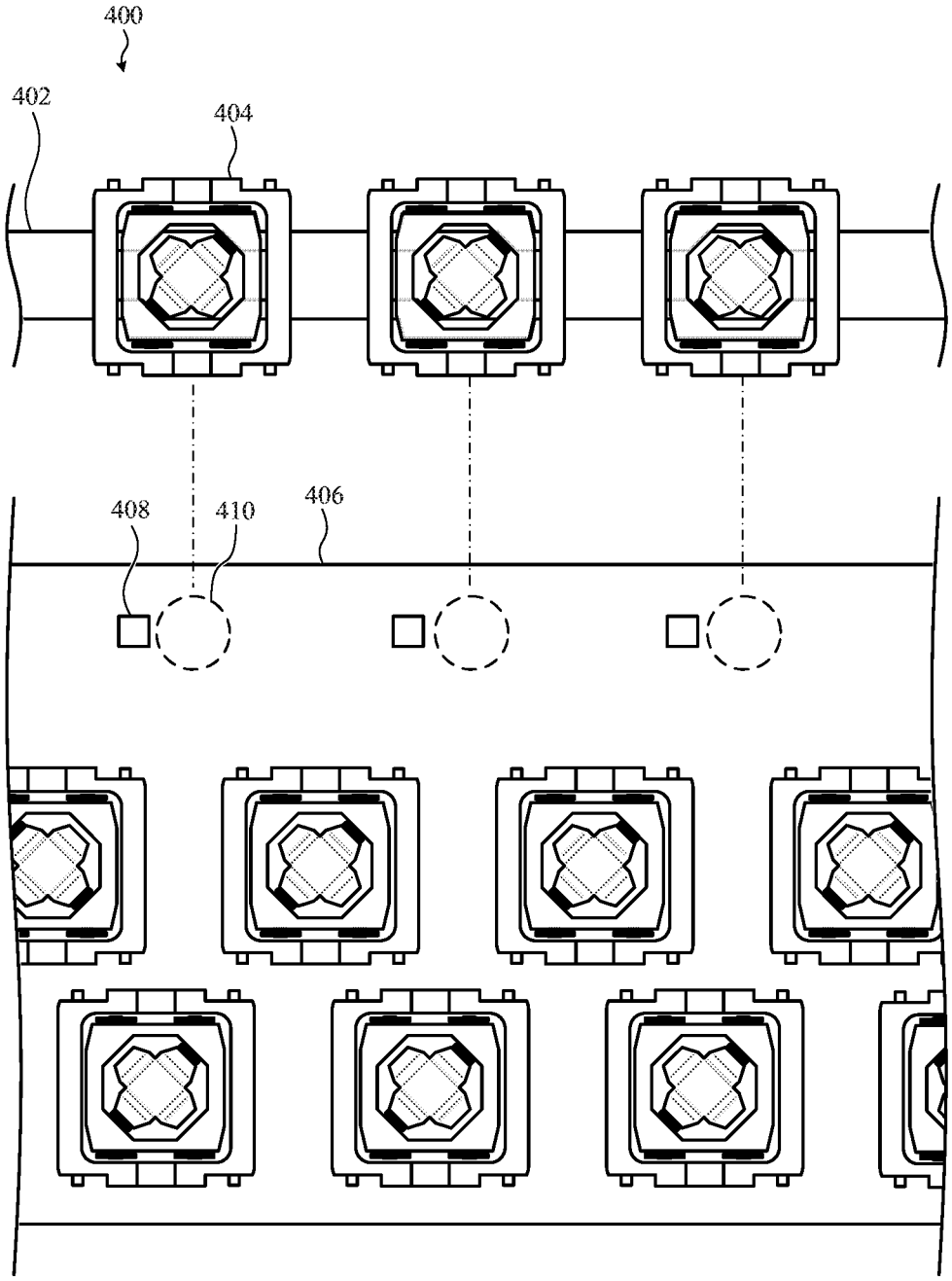
FIG. 4A depicts a top view of a chassis strip that includes a number of prefabricated key assemblies, positioned over a feature plate of a keyboard.

FIG. 4A depicts a top view of a chassis strip that includes a number of prefabricated key assemblies, positioned over a feature plate of a partially-assembled feature plate 400. As illustrated, a chassis strip 402 includes a number of prefabricated key assemblies, one of which is identified as the prefabricated key assembly 404.

The chassis strip 402 is positioned above a feature plate 406. The feature plate 406 can be a substantially planar substrate. In many embodiments, the feature plate 406 may not require any particular geometry and/or features. In this manner, the feature plate 406 may not require special manufacturing or handling. In some cases, the feature plate 406 is populated with one or more electrical components, traces, or registration fiducials or indicia prior to receiving the chassis strip 402. As shown, the feature plate 406 is previously populated with a number of light-emitting diodes, one of which is identified as the light emitting diode 408.

The chassis strip 402 can be aligned over the feature plate 406 such that the prefabricated key assembly 404 aligns with a location 410. The location 410 can be identified by or as a fiducial or other indicia suitable for registration by an automated assembly mechanism, such as a pick and place machine. In some cases, the location 410 can be associated with one or more electrical contact pads formed onto the substrate. The electrical contact pads can be associated with an electrical switch, a backlight circuit, a sensor circuit (e.g., force sensor, touch sensor, depression depth sensor, temperature sensor, and so on), or any combination thereof.

In other examples, the chassis strip 402 can be aligned over the feature plate 406 such that the prefabricated key assembly 404 aligns with the light emitting diode 408. The light emitting diode 408 can be a backlight associated with the prefabricated key assembly 404. The light emitting diode 408 can be identified by or as a fiducial or other indicia suitable for registration by an automated assembly mechanism, such as a pick and place machine.

In other cases, both the location 410 and the light emitting diode 408 can function as alignment fiducials and/or indicia that may be registered by an automated assembly mechanism, such as a pick and place machine.

Figure 4B:
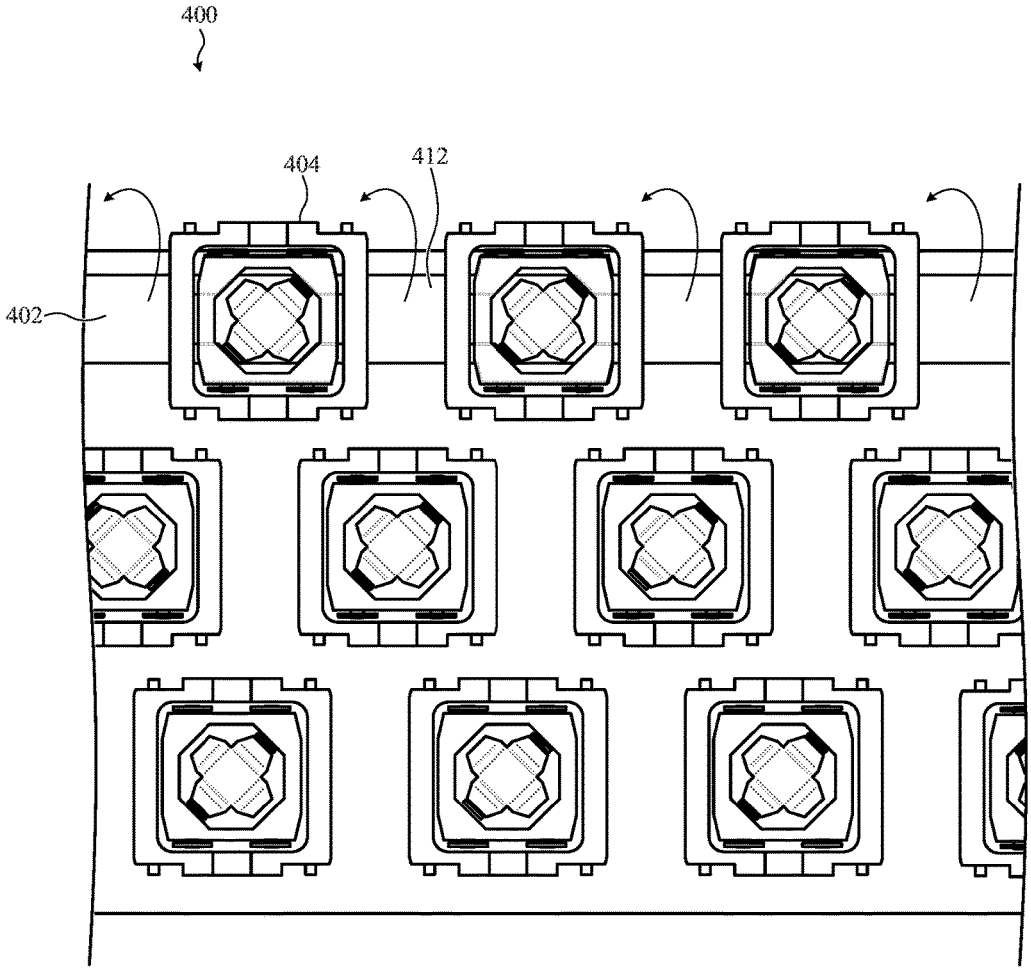
FIG. 4B depicts the chassis strip and keyboard of FIG. 4A, showing the chassis strip attached to the feature plate of the keyboard, identifying interconnecting portions of the chassis strip between prefabricated key assemblies that may be ejected in a subsequent operation.

Once the chassis strip 402 is aligned with the feature plate 406, the chassis strip 402 can be permanently or temporarily mounted and/or affixed to the feature plate 406, such as shown in FIG. 4B. The operation of affixing the chassis strip 402 to the feature plate 406 can be accomplished in any number of suitable ways including, but not limited to, welding, soldering, adhering, clamping, heat staking, and so on.

After the chassis strip 402 is mounted and/or affixed to the feature plate 406, the individual prefabricated key assemblies can be attached to the feature plate 406. For example, the prefabricated key assembly 404 can be mounted and/or affixed to the feature plate 406 using any suitable technique such as, but not limited to, welding, soldering, adhering, heat staking, and so on.

Figure 4C:
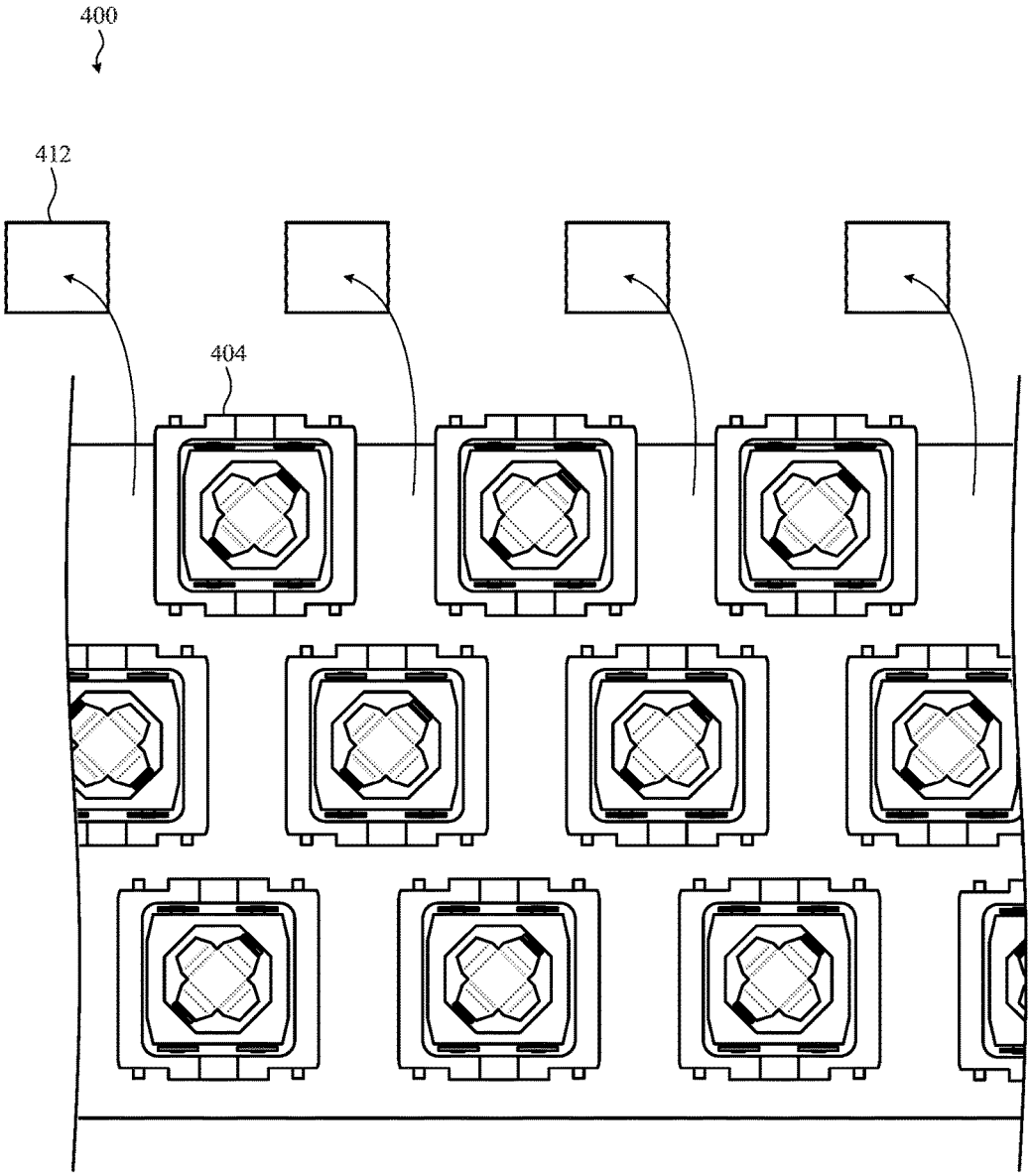
FIG. 4C depicts the chassis strip and keyboard of FIG. 4B, showing ejection of the interconnecting portions between prefabricated key assemblies.
Figure 4D:
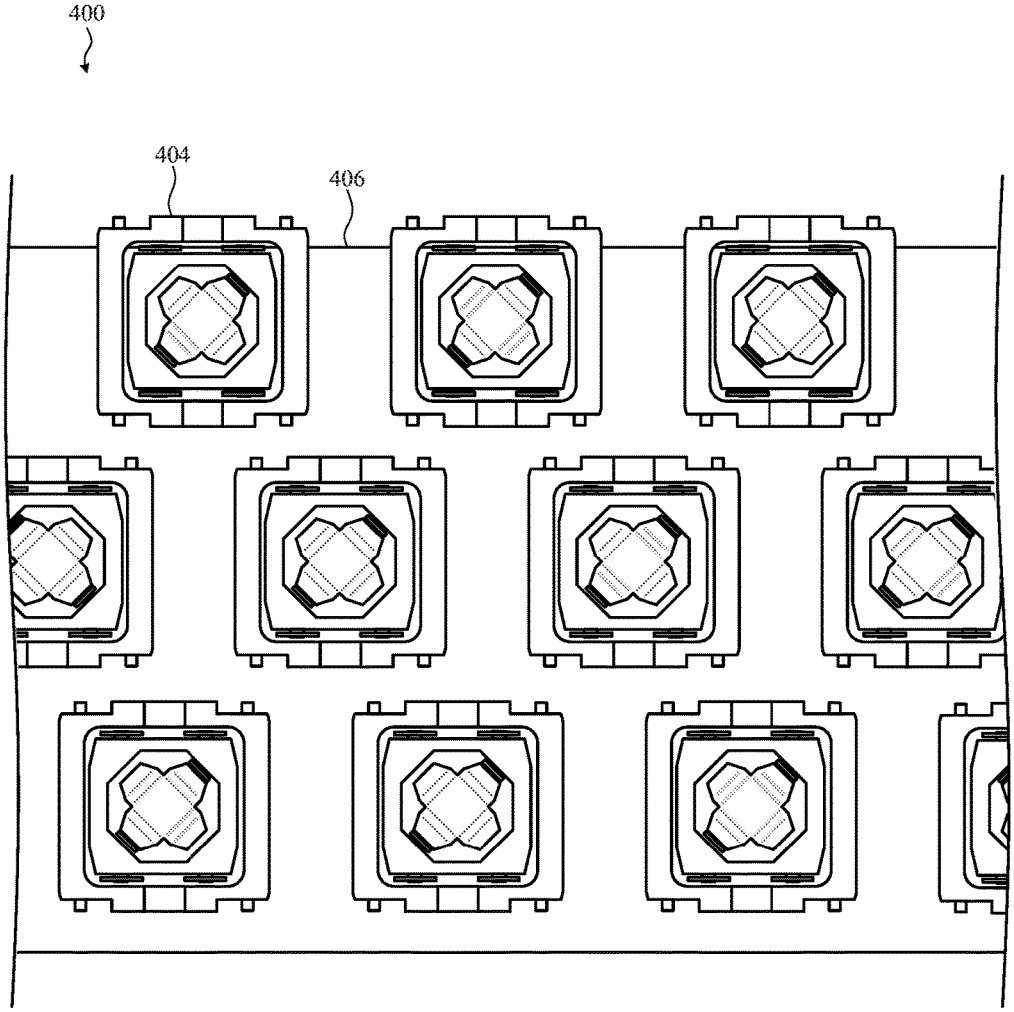
FIG. 4D depicts the chassis strip and keyboard of FIG. 4C, showing singulated key assemblies independently mounted and/or affixed to the feature plate of the keyboard.

Once the prefabricated key assembly 404 is independently mounted and/or affixed to the feature plate 406, interconnecting portions between prefabricated key assemblies can be ejected, eliminated, or otherwise removed using an appropriate technique. One interconnecting portion between prefabricated key assemblies of the chassis strip 402 is labeled as the interconnecting portion 412. FIG. 4C depicts the interconnecting portion 412 removed and ejected.

In one example, the interconnecting portions are removed by breaking a perforation or other breakaway feature, such as the perforation 310 depicted in FIG. 3A. In another embodiment, the interconnecting portions can be removed by laser cutting, laser ablation, chemical etching, chemical degradation and manual ejection, mechanical routing and ejection and so on.

In many cases, the operation of affixing the prefabricated key assembly 404 to the feature plate 406 can be the same operation that results in the ejection of the interconnecting portion 412. For example, laser cutting along a perforation may serve to weld and/or solder the prefabricated key assembly 404 to the feature plate 406 while simultaneously separating the interconnecting portion 412 from the chassis strip 402. In further embodiments, the operation of affixing the prefabricated key assembly 404 to the feature plate 406 can also connect one or more portions of the key assembly to an electrical circuit. For example, laser cutting along a perforation may serve to weld and/or solder the prefabricated key assembly 404 to the feature plate, connecting a portion of the key assembly to an electrical circuit such as an electrical switch, while simultaneously separating the interconnecting portion 412 from the chassis strip 402.

In addition, the operation of affixing the prefabricated key assembly 404 to the feature plate 406 can electrically isolate conductive portions of one key assembly from electrically conductive portions of an adjacent key assembly.

Once the interconnecting portions between adjacent key assemblies are removed, the chassis strip 402 is, effectively, depanelized. Each key assembly is accurately and precisely placed onto the feature plate 406 (see, e.g., FIG. 4D) of the partially-assembled feature plate 400. Thereafter, the partially-assembled feature plate 400 can be referred to as a "singulated" feature plate.

Generally and broadly, FIGS. 5A-5D depict various example intermediate stages associated with a method of manufacturing a singulated feature plate such as described herein. In particular, a chassis strip is populated with a number of key assemblies, such as the key assembly 200 depicted in FIG. 2, and thereafter positioned over and affixed to a feature plate of a keyboard. Once affixed to the keyboard, the key assemblies may be singulated, thereby depanelizing the chassis strip.

As noted with respect to other embodiments described herein, a process of manufacturing a singulated feature plate for a keyboard may occur in stages. FIGS. 5A-5D are provided to illustrate intermediate stages of one example process of manufacturing a singulated feature plate, although it is appreciated that the order presented herein is not required. Similarly, additional or fewer operations may be performed in particular implementations.

Figure 5A:
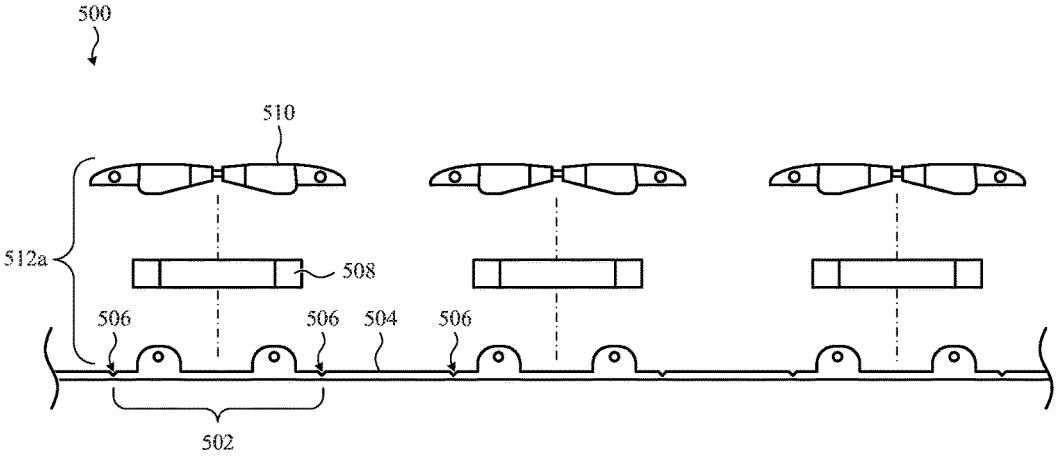
FIG. 5A depicts a side assembly view of a chassis strip that may be used to fabricate key assemblies.

FIG. 5A depicts a side assembly view of a chassis strip 500 that may be used to fabricate key assemblies. The chassis strip 500 defines a row of chassis, one of which is identified as the chassis 502. Adjacent chassis can be separated by interconnecting portions, one of which is identified as the interconnecting portion 504. The interconnecting portion 504 can be at least partially defined by a breakaway feature, such as a perforation, score, or channel, identified as the singulating lines 506. As with other embodiments described herein, the chassis 502 can receive various parts of a key assembly such as a switch housing 508 and a key mechanism 510. The key assembly is identified as the key assembly 512*a*.

It may be appreciated that for the simplicity of illustration other parts or components that may be required for a key assembly 512*a* are not shown. Such components or parts may include a keycap, a switch structure, a buckling dome, an optical film, an electric circuit, a light guide, and so on.

Figure 5B:
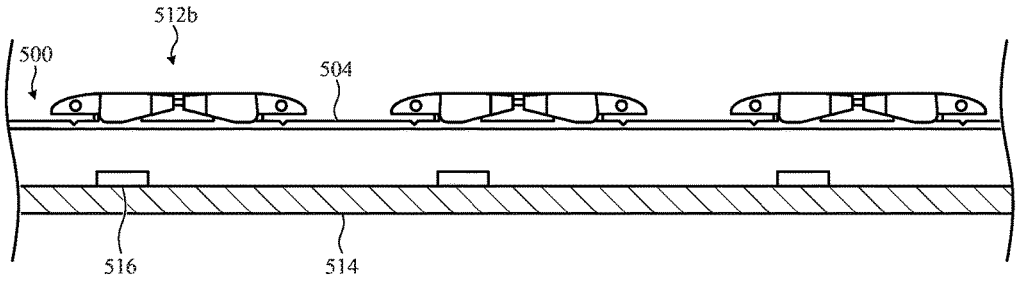
FIG. 5B depicts the chassis strip of FIG. 5A including a number of prefabricated key assemblies, positioned above a feature plate of a keyboard.

FIG. 5B depicts the chassis strip 500 of FIG. 5A including a number of prefabricated key assemblies, one of which is identified as the prefabricated key assembly 512*b*, positioned above a feature plate 514 of a keyboard. The feature plate 514 can include one or more light emitting diodes, one of which is identified as the light emitting diode 516. In many embodiments, the chassis strip 500 can be aligned by registering the position and placement of the light emitting diode 516. In this manner, the light emitting diode 516 can serve as an alignment fiducial. In other cases, the chassis strip 500 can be aligned by registering the position and placement of one or more fiducials formed on a top surface of the feature plate 514.

Figure 5C:
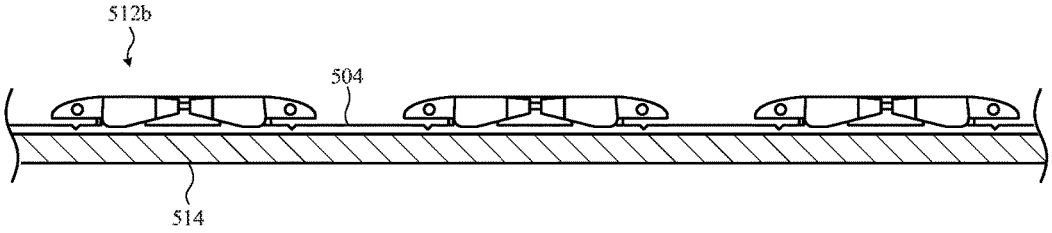
FIG. 5C depicts the chassis strip and feature plate of FIG. 5B, particularly showing the prefabricated key assemblies coupled to the feature plate of the keyboard.

FIG. 5C depicts the chassis strip and feature plate of FIG. 5B, particularly showing the prefabricated key assemblies, including the prefabricated key assembly 512*b*, coupled to the feature plate 514 of the keyboard. As noted with respect to other embodiments described herein, the prefabricated key assemblies can be coupled, affixed, bonded, joined, or otherwise attached to the feature plate 514 in any number of suitable ways. In many embodiments, each individual prefabricated key assembly of the prefabricated key assemblies is independently affixed to the feature plate 514. In these embodiments, the interconnecting portions between the prefabricated key assemblies, such as the interconnecting portion 504, may not be coupled to (e.g., disconnected from) the feature plate 514.

Figure 5D:
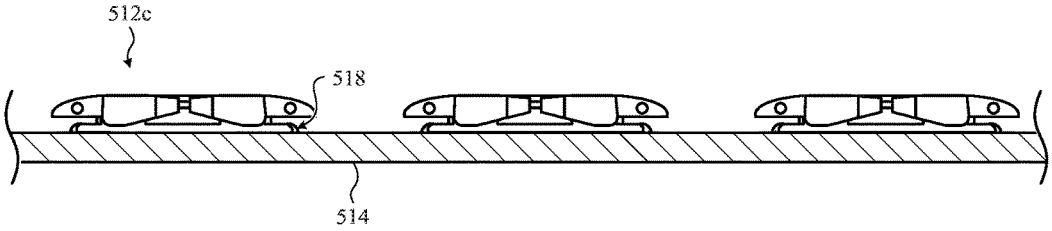
FIG. 5D depicts the feature plate of FIG. 5C, showing ejection of interconnecting portions of the chassis strip between prefabricated key assemblies, thereby singulating the prefabricated key assemblies.

FIG. 5D depicts the feature plate 514 of FIG. 5C, showing interconnecting portions of the chassis strip (not shown) between prefabricated key assemblies removed, thereby singulating the key assemblies. One such singulated key assembly is identified as the singulated key assembly 512*c*. As noted with respect to other embodiments described herein, the operation of affixing the prefabricated key assemblies to the feature plate 514 can be the same operation that results in the ejection of the interconnecting portion, such as the interconnecting portion 504 depicted in FIGS. 5A-5C. For example, laser cutting along one or more singulating lines may serve to weld and/or solder the prefabricated key assemblies to the feature plate 514 while simultaneously separating the interconnecting portions from the chassis strip. One such example solder interface is identified as the solder joint 518. In further embodiments, the operation of affixing the prefabricated key assemblies to the feature plate 514 can also connect one or more portions of the key assembly to an electrical circuit (not shown). For example, laser cutting along a singulating line may serve to weld and/or solder the prefabricated key assemblies to the feature plate 514, connecting a portion of the key assembly to an electrical circuit such as an electrical switch, while simultaneously separating the interconnecting portions from the chassis strip.

FIGS. 5E-5H depict various example intermediate stages associated with a method of manufacturing a singulated feature plate such as described herein. In particular, a chassis strip is populated with a number of key assemblies, such as the key assembly 200 depicted in FIG. 2, and thereafter positioned over a feature plate of a keyboard. In this embodiment, heat staking features extending from each switch housing of the key assemblies are deformed against an underside of the feature plate, thereby affixing the chassis strip to the feature plate. Once affixed to the keyboard, the key assemblies may be singulated, thereby depanelizing the chassis strip.

As noted with respect to other embodiments described herein, a process of manufacturing a singulated feature plate for a keyboard may occur in stages. FIGS. 5E-5H are provided to illustrate intermediate stages of one example process of manufacturing a singulated feature plate by heat staking (or otherwise deforming) portions of a key assembly to the feature plate, although it is appreciated that the order presented herein is not required. Similarly, additional or fewer operations may be performed in particular implementations.

Figure 5E:
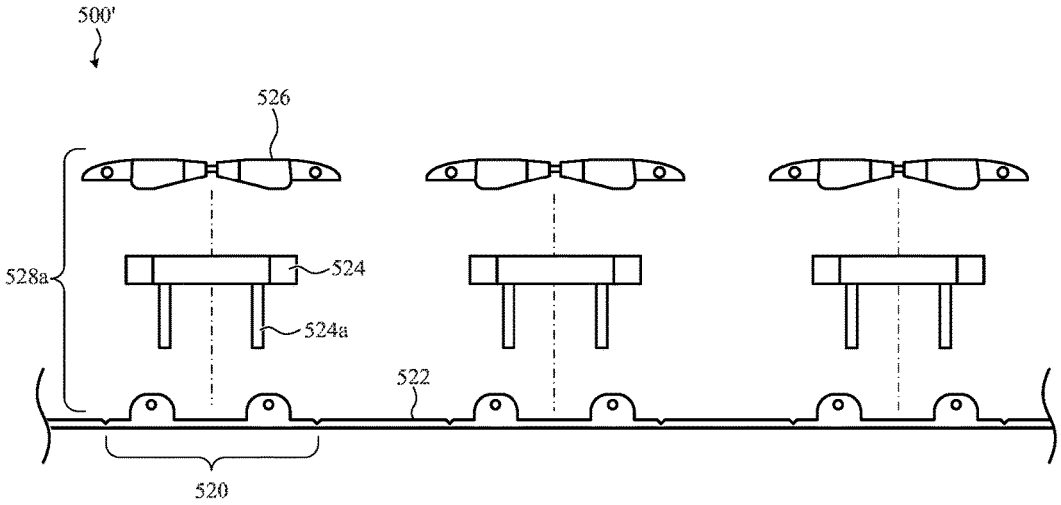
FIG. 5E depicts a side assembly view of another chassis strip that may be used to fabricate key assemblies.

FIG. 5E depicts a side assembly view of a chassis strip 500' that may be used to fabricate key assemblies. As with the embodiments described above in reference to FIGS. 5A-5D, the chassis strip 500' defines a row or chain of chassis, one of which is identified as the chassis 520. Adjacent chassis can be separated by interconnecting portions, one of which is identified as the interconnecting portion 522. As with other embodiments described herein, the interconnecting portion 522 can be at least partially defined by a perforation or channel.

As with other embodiments described herein, the chassis 520 can receive various parts of a key assembly such as a switch housing 524 and a key mechanism 526. The key assembly is identified as the key assembly 528*a*.

The switch housing 524 is formed with one or more protrusions, one of which is identified as the protrusion 524*a*. The protrusion 524*a* can be formed from any number of suitable materials, but in many embodiments, is formed from the same material as the switch housing 524. The protrusion 524*a* can be formed as an integral portion of the switch housing 524. In many cases, the switch housing 524 includes more than one protrusion, although this may not be required. For example, a single protrusion formed with a particular shape (e.g., cross shape, triangular shape, and so on) may be suitable in some embodiments.

It may be appreciated that for the simplicity of illustration other parts or components that may be required for a key assembly 528*a* are not shown. Such components or parts may include a keycap, a switch structure, a buckling dome, an optical film, an electric circuit, a light guide, and so on.

Further, it may be appreciated that the protrusion 524*a* need not necessarily extend from the switch housing. In some embodiments, the protrusion 524*a* may extend from the chassis 520. In still further embodiments, the protrusion 524*a* may be a separate part that is configured to extend through one or more of the switch housing 524 and the chassis 520. In other cases, more than one element of the key assembly can include a protrusion 524*a*; a first protrusion can extend from the switch housing whereas a second protrusion extends from the chassis.

Figure 5F:
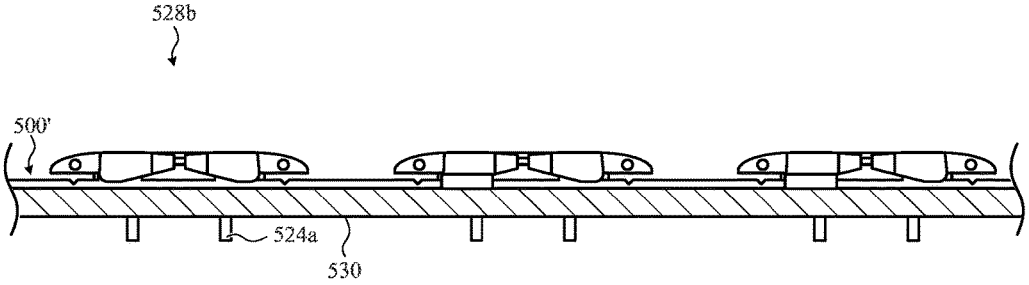
FIG. 5F depicts the chassis strip of FIG. 5E including a number of prefabricated key assemblies with heat stake features, positioned through corresponding holes in a feature plate of a keyboard.

FIG. 5F depicts the chassis strip 500' of FIG. 5E including a number of prefabricated key assemblies, one of which is identified as the prefabricated key assembly 528*b*, on a feature plate 530 of a keyboard. The feature plate 530 can include one or more light emitting diodes, electrical circuits, or contact pads one or more of which can serve as an alignment fiducial for aligning the prefabricated key assembly 528*b* with the feature plate 530. In other cases, the chassis strip 500' can be aligned by registering the position and placement of one or more fiducials formed on a top surface of the feature plate 530. The feature plate 530 can also define a through-hole or aperture that is configured to accommodate and/or receive the protrusion 524*a*.

Figure 5G:
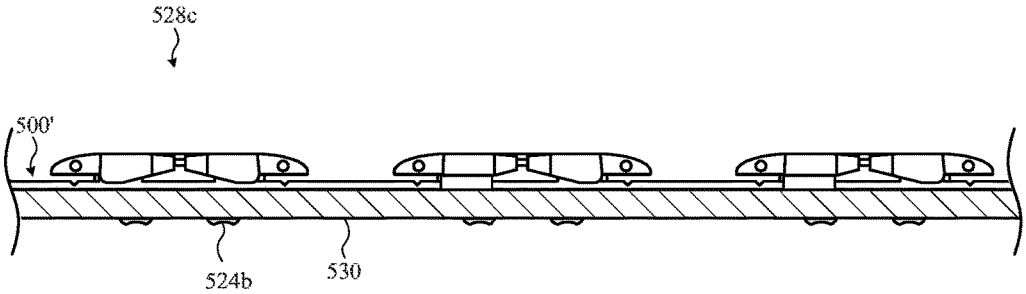
FIG. 5G depicts the chassis strip and feature plate of FIG. 5F, particularly showing the heat stake features of the prefabricated key assemblies deformed against an underside of the feature plate.

FIG. 5G depicts the chassis strip and feature plate of FIG. 5F, particularly showing the prefabricated key assemblies, including the prefabricated key assembly 528*b*, coupled to the feature plate 530 of the keyboard after deformation of the protrusion 524*a*. After deformation, the protrusion 524*a* is identified as the retainer 524*b*. In some cases, the retainer 524*b* is formed in a heat staking process. In other embodiments, the retainer 524*b* is formed by bending, folding, twisting, or otherwise manipulating the protrusion 524*a*.

Figure 5H:
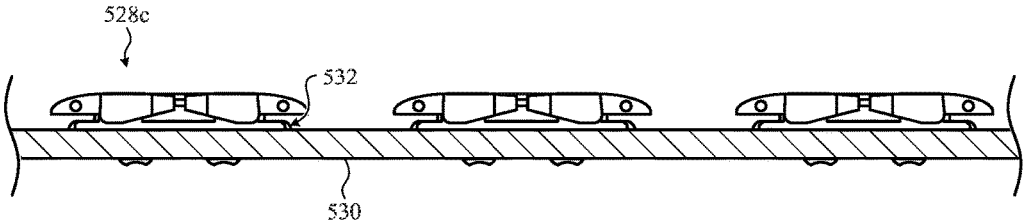
FIG. 5H depicts the feature plate of FIG. 5G, showing ejection of interconnecting portions of the chassis strip between prefabricated key assemblies, thereby singulating the prefabricated key assemblies.

FIG. 5H depicts the feature plate 530 of FIG. 5G, showing interconnecting portions of the chassis strip (not shown) between prefabricated key assemblies removed, thereby singulating the key assemblies. One such singulated key assembly is identified as the singulated key assembly 528*c*. As noted with respect to other embodiments described herein, the operation of affixing the prefabricated key assemblies to the feature plate 530 can be the same operation that results in the ejection of the interconnecting portion, such as the interconnecting portion 522 depicted in FIG. 5E. For example, laser cutting along one or more singulating lines may serve to weld and/or solder the prefabricated key assemblies to the feature plate 530 while simultaneously separating the interconnecting portions from the chassis strip. One such example solder interface is identified as the solder joint 532. In further embodiments, the operation of affixing the prefabricated key assemblies to the feature plate 530 can also connect one or more portions of the key assembly to an electrical circuit (not shown). For example, laser cutting along a singulating line may serve to weld and/or solder the prefabricated key assemblies to the feature plate 530, connecting a portion of the key assembly to an electrical circuit such as an electrical switch, while simultaneously separating the interconnecting portions from the chassis strip.

Figure 6A:
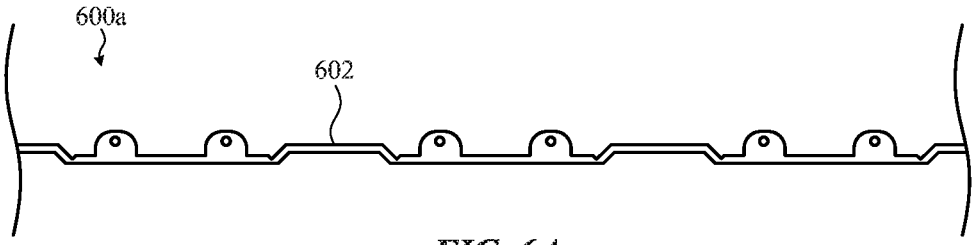
FIG. 6A depicts a side view of a chassis strip that may be used to fabricate a number of key assemblies such as described herein.
Figure 6B:
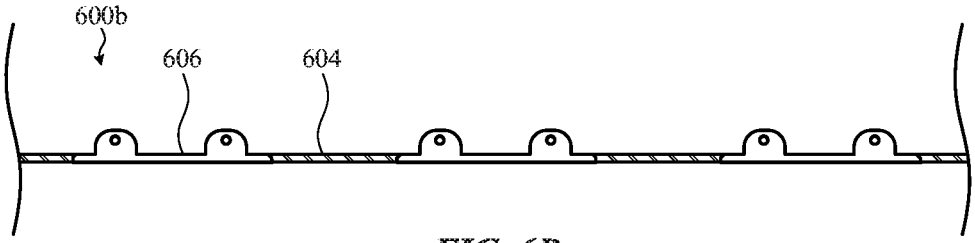
FIG. 6B depicts a side view of another substrate that may be used to fabricate a number of key assemblies such as described herein.

In the embodiment illustrated in FIGS. 5A-5H, the interconnecting portions between chassis of a chassis strip are formed from the same material as the chassis and are formed generally in the same plane as the plane of the chassis strip. However, this may not be required. For example, FIG. 6A depicts a side view of a chassis strip 600*a* having interconnecting portions, such as the interconnecting portion 602, that are elevated with respect to the plane of the chassis strip. This configuration may make the operation of singulating the prefabricated key assemblies simpler. Alternatively, FIG. 6B depicts a side view of a chassis strip 600*b* having interconnecting portions, such as the interconnecting portion 604, that are a different material from the chassis, such as the chassis 606. In these embodiments, the interconnecting portion 604 can be made from a disposable or disintegrable material such as can be removed by melting, dissolving, etching, ablating, blasting, and so on. The interconnecting portion 604 can be formed from plastic, glass, a different metal from the chassis 606, or any other suitable material. In further embodiments, an interconnecting portion may be configured to be received in an aperture, recess, or indentation defined in a feature plate. In such an embodiment, removal of the interconnecting portions may not be required. For example, FIG. 6C depicts a side view of a chassis strip 600*c* having interconnecting portions, such as the interconnecting portion 608, that are lower than the plane of the chassis strip.

Figure 6C:
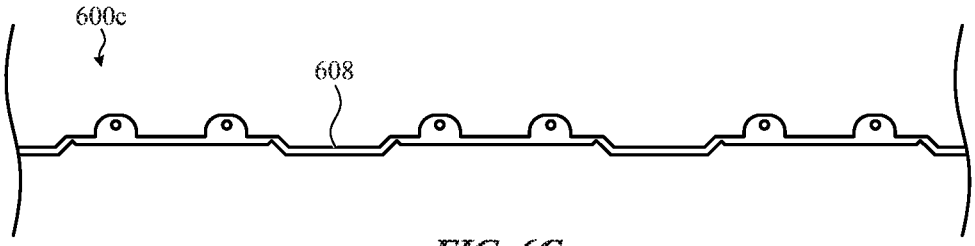
FIG. 6C depicts a side view of another substrate that may be used to fabricate a number of key assemblies such as described herein.

It may be appreciated that the foregoing description of FIGS. 6A-6C, and various alternatives thereof and variations thereto are presented, generally, for purposes of explanation, and to facilitate a thorough understanding of various possible configurations of a chassis strip. However, it will be apparent to one skilled in the art that some of the specific details presented herein may not be required in order to practice a particular described embodiment, or an equivalent thereof. In particular, it may be appreciated that the chassis strip described above can be assembled and/or manufactured in any number of suitable ways.

As noted above, once the chassis strip is depanelized, the feature plate can be referred to as a singulated keyboard. Generally and broadly, FIGS. 7A-7D depict various example intermediate stages associated with a method manufacturing a singulated keyboard by positioning a singulated feature plate relative to one or more apertures defined through a housing of the singulated keyboard. In some cases, the housing may be a housing of an electronic device that incorporates the singulated keyboard, such as the electronic device 100 depicted in FIG. 1A.

As noted with respect to other embodiments described herein, a process of manufacturing a singulated keyboard may occur in stages. FIGS. 7A-7D are provided to illustrate intermediate stages of one example process of manufacturing a singulated keyboard, although it is appreciated that the order presented herein is not required. Similarly, additional or fewer operations may be performed in particular implementations.

Figure 7A:
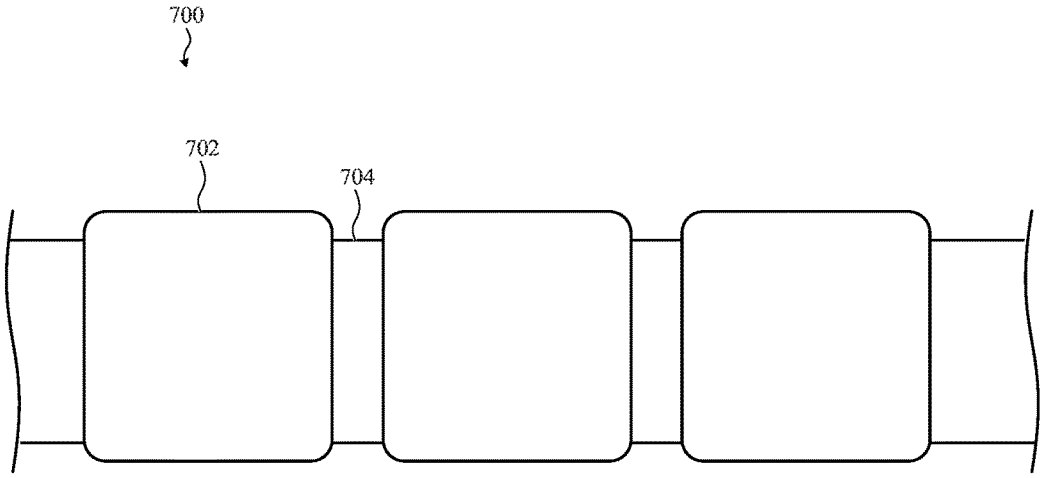
FIG. 7A depicts a top view of a feature plate of a keyboard including multiple prefabricated key assemblies independently coupled to the feature plate and particularly showing keycaps attached to each of the prefabricated key assemblies.
Figure 7B:
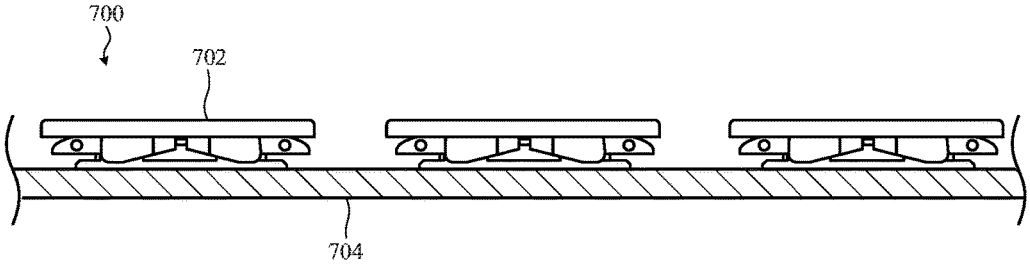
FIG. 7B is a side view of the feature plate and key assemblies depicted in FIG. 7A.

FIGS. 7A-7B depict a top and side cross-section view, respectively, of a singulated feature plate 700 of a keyboard. The singulated feature plate 700 includes multiple singulated key assemblies and keycaps (collectively, "keys"), such as the key 702, independently affixed to a feature plate 704.

Figure 7C:
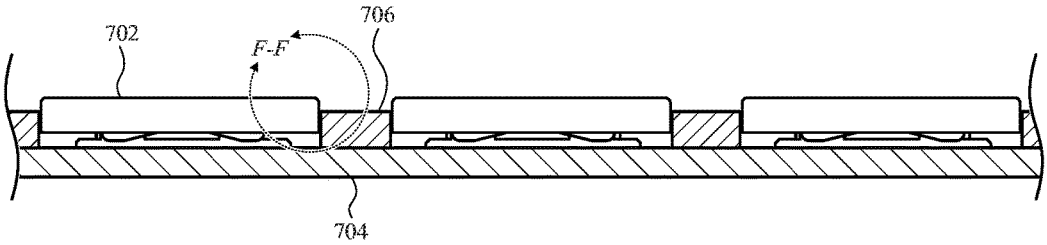
FIG. 7C depicts the feature plate of FIG. 7B disposed within a housing of an electronic device such that each key assembly and keycap is positioned relative to an aperture defined through the housing.
Figure 7D:
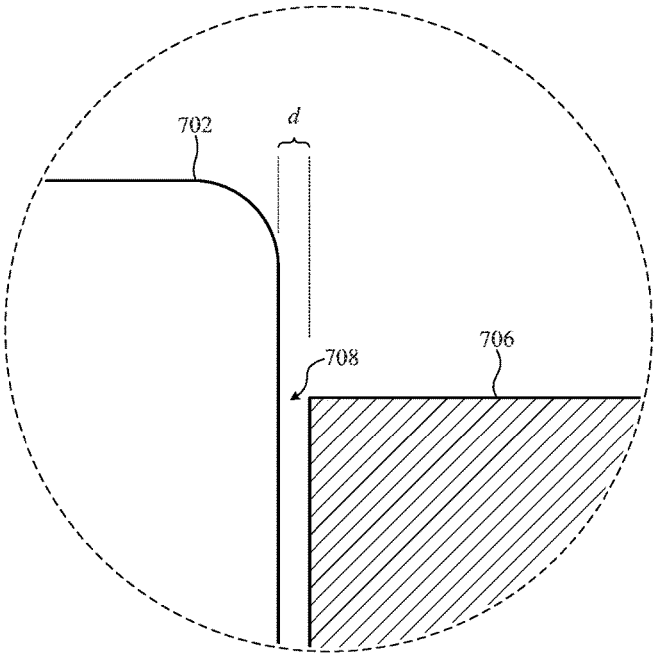
FIG. 7D depicts the enclosed circle F-F of FIG. 7C, specifically showing one key assembly positioned relative to an aperture defined through the housing.

FIG. 7C depicts the feature plate of FIG. 7B disposed within a housing 706 of an electronic device. The electronic device can be a keyboard, a laptop computing device, or any suitable electronic device. FIG. 7D depicts the enclosed circle F-F of FIG. 7C, specifically showing the key 702 positioned relative to an aperture 708 defined through the housing 706 of the electronic device. In many embodiments, an edge of the key 702 is separated by a distance d from a sidewall of the aperture 708. The distance d can vary from embodiment to embodiment. In certain cases, the distance d is substantially constant around the periphery of the key 702.

Figure 8:
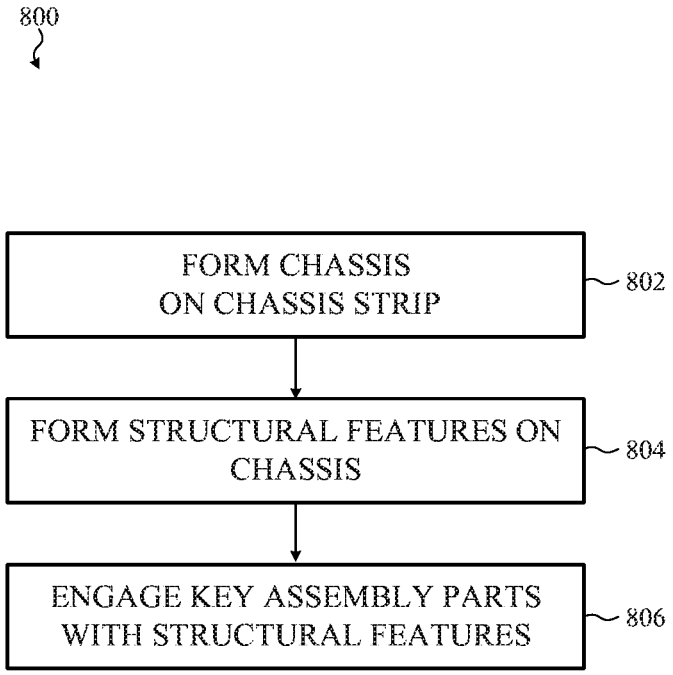
FIG. 8 is a flow chart depicting example operations of a method of fabricating key assemblies on a chassis strip.
Figure 9:
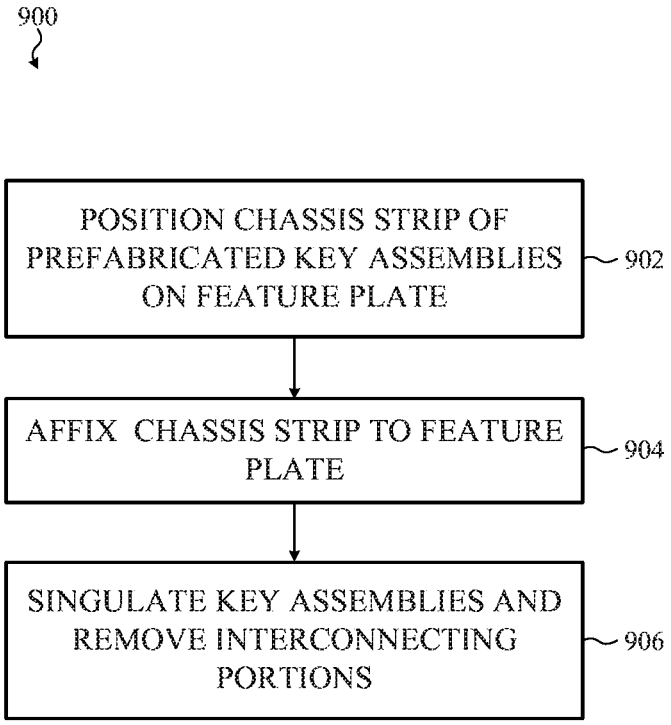
FIG. 9 is a flow chart depicting example operations of a method of assembling a keyboard by deferring depanelization of a panelized substrate of prefabricated key assemblies.
Figure 10:
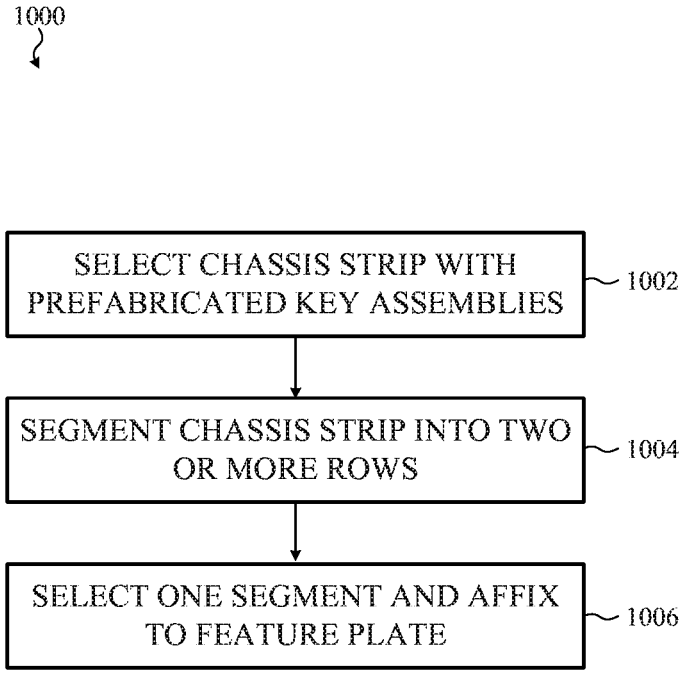
FIG. 10 is a flow chart depicting example operations of manufacturing a chassis strip of prefabricated key assemblies.

The embodiments described above with reference to FIGS. 2A-7D are provided, generally, to facilitate an understanding of methods of assembling a singulated keyboard such as described herein, and, in particular a low-profile singulated keyboard that may be incorporated into a low-profile electronic device such as a laptop computer or a cover for a tablet or other electronic device. FIGS. 8-10 are provided as simplified flow charts depicting example operations of such methods. It may be appreciated, however, that the operations and steps presented with respect to these methods and techniques, as well as other methods and techniques described herein, are meant as exemplary and accordingly are not exhaustive. One may further appreciate that an alternate step order or fewer or additional steps may be implemented in particular embodiments.

FIG. 8 is a flow chart depicting example operations of a method of fabricating key assemblies on a chassis strip. The method 800 begins at operation 802 in which one or more chassis are formed onto a chassis strip. In one example, the chassis are formed by stamping sheet metal or feed stock. The spacing between the chassis corresponds to the spacing between keys of a keyboard. Next, at operation 804, structural features can be formed on, in, or with the chassis formed at operation 802. In one example, tabs extending from the chassis can be bent upwardly (see, e.g., the key mechanism retaining feature 220 as shown in FIG. 2). Next, at operation 806, a key assembly part or more than one key assembly part, can be engaged with the structural features formed at operation 804 (see, e.g., FIGS. 2F-2I).

FIG. 9 is a flow chart depicting example operations of a method of assembling a keyboard by deferring depanelization of a panelized substrate of prefabricated key assemblies (e.g., chassis strip). The method depicted may be related to the embodiment depicted in FIGS. 4A-5D. The method 900 begins at operation 902 in which a chassis strip with prefabricated key assemblies is positioned over and aligned with a feature plate. Next, at operation 904, the chassis strip may be affixed to the feature plate. Next, at operation 906, the prefabricated key assemblies are singulated by removing interconnecting portions between the key assemblies.

As noted with respect to other embodiments described herein, the interconnecting portions between the key assemblies can be removed using any suitable technique or combination of techniques. For example, the interconnecting portions can be removed by breaking two or more perforations defining the edges of the interconnecting portions. As a result of the breaking operation, the key assemblies are singulated and the panelized substrate of prefabricated key assemblies is depanelized. More specifically, the various key assemblies can be mechanically, electrically, and physically separated from one another.

In other examples, the interconnecting portions can be removed by laser or acoustic welding the key assemblies to the feature plate; the operation of laser or acoustic welding can cause one or more perforations defining the edges of the interconnecting portions to weaken or separate. As a result of the welding operation, the key assemblies are singulated and the panelized substrate of prefabricated key assemblies is depanelized. In some cases, the operation of welding can electrically connect one or more chassis to one or more electrical circuits or traces accommodated on a top surface of the feature plate.

In another example, the interconnecting portions between key assemblies can be formed from a dissolvable or disintegrable material. In these examples, the dissolvable or disintegrable material may be disintegrated or dissolved using a suitable process. As a result of the disintegration or dissolution operation, the key assemblies are singulated and the panelized substrate of prefabricated key assemblies is depanelized. In some cases, the operation of disintegrating and/or dissolving the interconnecting portions can also clean or dissolve other portions of the feature plate.

In yet another example, the interconnecting portions between the key assemblies can be formed from solder. The chassis strip and feature plate can be placed in a reflow oven, causing the interconnecting portions to melt and wet to separate electrical contacts accommodated on a top surface of the feature plate. In many cases, the separate electrical contacts may be treated with flux prior to the reflow operation. The separated electrical contacts can be associated with electrical signal paths, electrical ground references, or may be floating. In some cases, the separate electrical contacts may be physically separated while being electrically connected by a trace (e.g., separated nodes of a circuit ground). The physical separation of the electrical contacts encourages the interconnecting portions between adjacent key assemblies to break. As a result of the reflow operation, the key assemblies are singulated and the panelized substrate of prefabricated key assemblies is depanelized.

FIG. 10 is a flow chart depicting example operations of manufacturing a chassis strip of prefabricated key assemblies. The method depicted may be related to the embodiment depicted in FIGS. 4A-5D. The method 1000 begins at operation 1002 in which a chassis strip having an arbitrary number of prefabricated key assemblies is selected. The chassis strip can correspond to multiple rows of keys of a keyboard. Next, at operation 1004, the chassis strip may be segmented into smaller chassis strips of prefabricated key assemblies. In this example, the segments of the chassis strip may each correspond to a respective one row of keys of a keyboard. Next, at operation 1006, one of the segments formed in operation 1004 can be selected and affixed to a feature plate of a keyboard.

In some cases, a single chassis strip having an arbitrary number of prefabricated key assemblies can correspond to a single row of multiple feature plates associated with multiple keyboards. In this example, multiple keyboards may be manufactured next to one another in a row. The single chassis strip can be positioned over a row of feature plates, separated by some distance from one another. The chassis strip may include interconnecting portions that interconnect a first row of a first feature plate with a corresponding second row of a second feature plate. The second feature plate may be positioned adjacent to the first feature plate.

Although many embodiments described herein reference low-profile singulated keyboards, it is appreciated that the methods and techniques described herein can additionally or alternatively be used to fabricate any number of assemblies or devices. For example, the methods described herein may be used in any suitable manner in the course of manufacturing or fabricating consumer or commercial products such as, but not limited to, user input devices, computing devices, display devices, backlight devices, tactile devices, wearable devices, tablet computing devices, industrial control devices, automotive devices, music devices, audiovisual devices, and so on.

Furthermore, it may be appreciated that although many embodiments described herein reference planar keyboards, other keyboard configurations are possible. For example, an ergonomic keyboard may have multiple feature plates arranged at angles relative to one another. In other examples, a number pad of a keyboard may include a separate feature plate.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. A keyboard assembly, comprising:

a feature plate;

a key assembly including a key mechanism and a keycap, the key mechanism being coupled to the keycap and facilitating translation of the keycap in response to a user input, the key mechanism defining an opening and including a protrusion extending into the opening;

a chassis affixed to the feature plate, the chassis comprising a key assembly retaining feature, the protrusion of the key mechanism being coupled to the key assembly retaining feature.

2. The keyboard assembly of claim 1, wherein the key mechanism is pivotally coupled to the key assembly retaining feature.

3. The keyboard assembly of claim 1, wherein the chassis comprises a bend at the key assembly retaining feature.

4. The keyboard assembly of claim 1, further comprising a removable interconnecting portion attaching the chassis to a second chassis.

5. The keyboard assembly of claim 1, wherein the key assembly includes a dome structure and the chassis includes a dome retaining feature, the dome structure being coupled with the dome retaining feature.

6. The keyboard assembly of claim 3, wherein the key assembly includes a switch structure having an internal opening, the dome retaining feature being positioned in the internal opening.

7. A keyboard assembly, comprising:

a base layer having a base layer aperture;

a key assembly including a switch structure, the switch structure having a protrusion, an internal opening and a buckling dome positioned in the internal opening;

a chassis affixed to the base layer, the chassis comprising a key assembly retaining feature and a chassis aperture, the buckling dome being coupled to the key assembly retaining feature and the protrusion being receivable by the base layer aperture and the chassis aperture.

8. The keyboard assembly of claim 7, wherein the chassis is configured to electrically connect the buckling dome to an electrical circuit accommodated on the base layer.

9. The keyboard assembly of claim 7, wherein a light source is formed into or otherwise coupled to the chassis.

10. The keyboard assembly of claim 7, wherein the chassis comprises a tab configured to electrically couple the chassis to a contact pad on the base layer.

11. The keyboard assembly of claim 7, further comprising a removable interconnecting portion attaching the chassis to a second chassis.

12. The keyboard assembly of claim 7, wherein the chassis comprises a central aperture.

13. The keyboard assembly of claim 12, wherein the key assembly retaining feature is positioned over the central aperture.

14. A keyboard, comprising:

a feature plate;

a chassis attached to the feature plate, the chassis having a set of key mechanism retaining portions and a set of dome retaining portions;

a switch structure coupled to the chassis, the switch structure having a perimeter, the set of key mechanism retaining portions being positioned spaced around the perimeter of the switch structure, the switch structure including an internal aperture and a dome positioned in the internal aperture, the set of dome retaining portions extending into the internal aperture and being coupled to the dome.

15. The keyboard of claim 14, wherein the switch structure further comprises a film positioned over the set of dome retaining portions.

16. The keyboard of claim 14, wherein the chassis comprises a set of respective bends where the set of key mechanism retaining portions are linked to the chassis.

17. The keyboard of claim 14, wherein each key mechanism retaining portion of the set of key mechanism retaining portions includes an aperture or notch.

18. The keyboard of claim 14, wherein the keyboard further comprises a keycap and a key mechanism, the keycap being coupled with the key mechanism, the key mechanism being coupled with one of the key mechanism retaining portions of the set of key mechanism retaining portions.

19. The keyboard of claim 18, wherein the key mechanism is pivotally coupled with the chassis.

* * * * *